US007868765B2

(12) United States Patent
Ishihara et al.

(10) Patent No.: US 7,868,765 B2
(45) Date of Patent: Jan. 11, 2011

(54) AFFIXING METHOD OF RFID LABEL AND ITS AFFIXING APPARATUS

(75) Inventors: Katsumasa Ishihara, Ichinomiya (JP); Takaaki Mizukawa, Hiroshima (JP)

(73) Assignees: Iwata Label Co., Ltd, Ichinomiya-shi (JP); Miyake, Inc., Hiroshima-shi (JP)

( * ) Notice: Subject to any disclaimer, the term of this patent is extended or adjusted under 35 U.S.C. 154(b) by 950 days.

(21) Appl. No.: 11/597,199

(22) PCT Filed: May 18, 2005

(86) PCT No.: PCT/JP2005/009056

§ 371 (c)(1),
(2), (4) Date: Nov. 21, 2006

(87) PCT Pub. No.: WO2005/115849

PCT Pub. Date: Dec. 8, 2005

(65) Prior Publication Data

US 2007/0252700 A1 Nov. 1, 2007

(30) Foreign Application Priority Data

May 26, 2004 (JP) ..... 2004-156781

(51) Int. Cl.
*G08B 13/14* (2006.01)

(52) U.S. Cl. ..... 340/572.7; 340/572.1; 340/10.1; 438/110

(58) Field of Classification Search ..... 340/572.7, 340/10.1, 572.1, 572, 7; 438/110
See application file for complete search history.

(56) References Cited

U.S. PATENT DOCUMENTS 6,451,154 B1 9/2002 Grabau et al.
6,471,802 B1 10/2002 Williamson (Continued)

FOREIGN PATENT DOCUMENTS

JP A-11-250365 9/1999

(Continued)

OTHER PUBLICATIONS

Notification of Reasons for Rejection dated Apr. 14, 2010 with English-language translation.

*Primary Examiner*—Daniel Wu
*Assistant Examiner*—John F Mortell
(74) *Attorney, Agent, or Firm*—Oliff & Berridge, PLC

(57) ABSTRACT

A display label, having a display section on a surface thereof and an adhesive surface on a back surface thereof, and an IC tag, provided with an antenna coil and an IC chip so as to transmit information through non-contact communication, are prepared. After writing information on the IC chip, reading test is applied, so as to separate non-defective ID tags and defective ID tags. After printing addition display on the surface of the display label, a non-defective ID tag is adhered on an adhesive surface thereof, so as to form an RFID label. Then the RFID label is affixed to an object-to-affix such as a container. An affixing method of an RFID label and its affixing method are provided, wherein an ID tag is less likely to be damaged, since the ID tag is not adhered on a display label while printing additional display.

19 Claims, 20 Drawing Sheets

U.S. PATENT DOCUMENTS

| | | | | |
|---|---|---|---|---|
| 6,969,134 | B2 * | 11/2005 | Hohberger et al. | 347/2 |
| 7,014,729 | B2 | 3/2006 | Grabau et al. | |
| 7,045,186 | B2 | 5/2006 | Grabau et al. | |
| 2002/0195194 | A1 | 12/2002 | Grabau et al. | |
| 2002/0195195 | A1 | 12/2002 | Grabau et al. | |
| 2003/0010433 | A1 | 1/2003 | Williamson | |
| 2003/0089444 | A1 | 5/2003 | Melzer et al. | |
| 2006/0255140 | A1 * | 11/2006 | Jusas et al. | 235/451 |

FOREIGN PATENT DOCUMENTS

| | | |
|---|---|---|
| JP | A-2002-531341 | 9/2002 |
| JP | 2002-298104 | 10/2002 |
| JP | 2003-530252 | 10/2003 |
| WO | WO 01/61646 A1 | 8/2001 |

* cited by examiner

State1

State2

State3

State2'

State3'

AFFIXING METHOD OF RFID LABEL AND ITS AFFIXING APPARATUS

RELATED APPLICATIONS

This application claims the priorities of Japanese Patent Application No. 2004-156781 filed on May 26, 2004, which are incorporated herein by reference.

BACKGROUND OF THE INVENTION

1. Field of the Invention

The present invention relates to an affixing method of RFID label and its affixing apparatus. More specifically, it relates to a method to affix an RFID label, which is provided with an antenna coil and an IC chip and capable of transmitting information to and from an external device through non-contact communication, to an object-to-affix such as a container or the like and its affixing apparatus.

2. Description of the Related Art

Conventionally bar-code has been used for stock management or sales management of a product. Recently, instead of this, use of a non-contact ID tag, which is capable of transmitting information through non-contact communication, has been increasing. This is an insulated substrate provided with an antenna coil and an IC chip, and capable of non-contact type information communication using electric wave. A resonance circuit is formed with the antenna coil, the IC chip and a capacitance element, and by receiving electric wave (information) from a writing mechanism disposed externally, it is capable of writing the information on the IC chip. Upon receiving electric wave from an external device (a reading mechanism), the information stored on the IC chip is sent to the external device.

Recently, an RFID label, united with a non-contact ID tag (also referred to an ID tag hereinafter) and a display label, as described above, has been used. An RFID label is provided with a display section for product information on a surface thereof, and an adhesive surface to adhere with an ID tag and to affix a product on a back surface thereof. By affixing an RFID label to a product, the product information can be read through non-contact communication, and thus it is useful for product management.

A sectional drawing and a back surface drawing of an RFID label 112 as describe above are shown in FIGS. 20A and 20B. A display label 105, adhesive 106, an ID tag 109, a double-sided adhesive tape 111, and a releasing member 107 are laminated. The ID tag 109 includes an antenna coil 113, an IC chip 114, an electro-conductive material 116 and a connecting terminal 115 provided on an insulated substrate 117. The ID tag 109 is adhered on the releasing member 107 to produce the RFID label 112. However in the existing circumstances there is a problem that a defective rate of the ID tag 109 is high and 5 to 20%. Therefore, before the adhesion, writing and reading test of information have been applied to the ID tag 109. Japanese Patent Application Laid-Open No. 2002-298104 discloses an example of a method for manufacturing an RFID label.

Patent Literature 1: Japanese Patent Application Laid-Open No. 2002-298104

The RFID tag 112 is affixed to a product. On a label affixing step, after separated off along a line-to-separate b to the individual RFID tag 112, the RFID tag is affixed to the product. This label affixing step is usually conducted by a manufacturer of the product to be an object-to-affix. Information printed on the label surface has permanent product information and such as a product name, a manufacturer name or the like, and updated product information such as date of manufacture, expiry date or the like. As shown in FIG. 20A, on the label surface, a display section to display the product information and a section-to-be-additionally-displayed for additional display of the updated product information are formed. If the updated product information such as date of manufacture, expiry date or the like is printed before production, in case that the product is not manufactured according to schedule, the label will have to be discarded. Thus the updated product information should be printed right before affixing the label. Also, information written on an ID tag, is not only information predetermined such as a product name, but also a manufacturer's serial number, expiry date or other traceability information, similarly to the information additionally displayed on the display label, and thus after filling of the object-to-affix as a product, the information is written, and then the label is affixed.

A printing method for additional display can be, for example, printing under pressing force such as sealing or the like, printing by pressing hot types, printing by laser or the like. Printing as described above had a problem that a non-defective ID tag 109 could be destroyed, in case that the non-defective ID tag was positioned on where additional display was printed, since heat or pressure could be applied or energy of laser could be reached. Thus, after printing the additional display, it was necessary to apply a test to the ID tag again. That is, it was necessary to apply a test for the ID tag twice, once at a manufacturing factory of the RFID label and once at its affixing site. As a result of the test, if the ID tag was recognized as defective, its display label 105 had to be discarded, causing increase of the production cost. Also, in case that change in display information of the label occurred, the ID tag preliminarily united with the label had to be discarded as well.

With the above described situations in the background, the present invention is conducted, and especially aims to provide an affixing method of RFID label and its affixing apparatus, wherein an ID tag is difficult to be damaged by printing additional display on a label, more than two tests of the ID tag are not required, and solving a problem that the ID tag preliminarily united has to be discarded in case that the label can not be used since the display information is changed.

SUMMARY OF THE INVENTION

In order to solve the above problems, an affixing method of an RFID label of the present invention, comprises:

(a)preparing more than one display label having a display section on a front surface thereof and an adhesive surface on a back surface thereof and more than one ID tag including an antenna coil and an IC chip so as to transmit information to and from an external device through non-contact communication;

(b) writing predetermined information on said IC chips of said ID tags, and then applying a reading test so as to separate non-defective ID tags having said information properly readable from defective ID tags having said information properly unreadable;

(c) printing additional display on a surface of said display label, and then affixing said non-defective ID tag on said adhesive surface thereof so as to form an RFID label having the non-defective ID tag and the printed display label united; and (d) affixing said RFID label to an object-to-affix such as a container.

In the present invention, a display label and a ID tag are stored in a state of being separated preliminarily. Additional display is printed on the display label, whereas a test of the ID tag is conducted so as to eliminate a defective ID tag. Then, right before affixing to a product, a non-defective ID tag and the display label having the additional display printed are laminated. In this way, though additional display is printed, pressure or heat would not applied on the ID tag, so as that the ID tag would not be damaged. Also, in case of change of display information, only the display label will be discarded, and it is not necessary to discard the expensive ID tag. Further, it is necessary to apply a test of the ID tag only right before affixing to a product, and a test is not always necessary by the manufacturer of the RFID label, and therefore cost reduction can be realized.

Also, in order to solve the above problems, an affixing apparatus of an RFID label of the present invention is configured, wherein:

a plurality of ID tags, including an antenna coil and an IC chip so as to transmit information to and from an external device through non-contact communication, are prepared to be aligned on a tape-shaped first releasing member through adhesive; and a plurality of display labels, having a display section on a front surface thereof and a adhesive surface on a back surface thereof, are prepared to be aligned on a tape-shaped second releasing member through adhesive, comprising:

(a) a tag supplying mechanism supplying said ID tag by winding up said first releasing member;

(b) a label supplying mechanism supplying said display label by winding up said second releasing member;

(c) a writing mechanism writing predetermined information on said ID tag;

(d) a testing mechanism applying a reading test on the written information;

(e) a defective eliminating mechanism eliminating the ID tag distinguished as defective by said testing mechanism (f) a printing mechanism printing additional display on a predetermined position of said display label;

(g)a tag conveying drum having a plurality of tag sticking sections on a surface thereof so as to stick said non-defective ID tag supplied by said tag supplying mechanism, and conveying said non-detective ID tag by rotation thereof;

(h) a label conveying drum, positioned so as that a rotation axis thereof is in parallel with that of said tag conveying drum and also that a surface thereof is contiguous with that of said tag conveying drum, sticking the printed display label supplied by said label supplying mechanism on a surface thereof and conveying said display label by rotation thereof and (i)an object-to-affix conveying mechanism, positioned so as to be contiguous with said label conveying drum, conveying an object-to-affix of said display label and said ID tag, wherein:

said writing mechanism, said testing mechanism and said defective eliminating mechanism are positioned in approximately parallel with said first releasing member, respectively writing said information, applying said reading test and conducting said defective elimination during transfer of said ID tag according to winding up of the first releasing member, so as to supply only said non-defective tag to said tag conveying drum;

in a contiguous area of said tag conveying drum and said label conveying drum, said non-defective ID tag is released from said tag conveying drum and then affixed to the adhesive surface of said display label, so as to form an RFID label united of the printed display label and the non-defective ID tag, and then said RFID label is conveyed having the display label side thereof stuck to said label conveying drum; and in a contiguous area of said object-to-affix conveying mechanism and said label convey drum, said RFID label is released from said label convey drum and then affixed to said object-to-affix.

The above label supplying mechanism and the tag supplying mechanism supplies a display label or an ID tag, for example, as follows. First the display label or the ID tag is prepared in a state of being arrayed on a tape-shaped releasing member in a predetermined interval also through adhesive. This releasing member means a member, being made of paper, film or the like, in a state that the display label and ID tag adhered thereto through adhesive can be easily released. One example of this is release paper. Also, "in a state of being arrayed" means being adhered in a state of that the display label or the ID tag is arrayed on a tape-shaped releasing member in a predetermined interval, and also on a unified side and in a unified direction. The releasing member is typically stored in a roll shape. By winding up the releasing member, and also bending it to a sharp angle, the display label or the ID tag is released to be supplied. In this specification, a first releasing member means a releasing member used for a tag supplying mechanism, and a second releasing member means a releasing member used for a label supplying mechanism.

Also, the present invention is provided with a tag conveying drum and a label conveying drum, and an ID tag or a display label is stuck on each drum surface. For example, a method is used, where forming small holes on the drum surface and giving negative pressure inside the drum, the ID tag or the display label is stuck on the holes. On the drum surface of the tag conveying drum, a tag sticking section is formed to stick the ID tag, and on the drum surface of the label conveying drum, a label sticking section is formed to stick a display label. These two drums rotate in the constant direction having their rotation axes parallel with each other, and also disposed in a position that the drum surfaces are contiguous with each other. The ID tag is supplied to the tag conveying drum, and the display label is supplied to the label conveying drum, and they are stuck on the drum surfaces and also conveyed according to rotation of each drum.

On the other hand, the present invention is provided with a writing mechanism of production information to an ID tag, and a testing mechanism to apply a reading test of the information, and a defective eliminating mechanism. By these mechanisms non-defective ID tags are selected. In case that an ID tag is supplied using a releasing member, it is preferable to dispose the writing mechanism, the testing mechanism and the defective eliminating mechanism approximately parallel with the releasing member. That is, the writing mechanism and the testing mechanism are disposed a little apart form the releasing member, so as to be capable of transmitting electric wave to and from the ID tag. This configuration allows writing, a reading test and defective elimination on the releasing member, so as to supply only a non-defective tag to the tag conveying drum.

Further the present invention is provided with a printing mechanism to print additional display to a display label. Printing is conducted in a state that an ID tag is not adhered thereon. In a contiguous area of the tag conveying drum and the label conveying drum, a non-defective ID tag and a display label having additional display printed are conveyed so as to contact with each other. The non-defective ID tag is released from the tag conveying drum, and then adhered on a back surface of the display label (adhesive surface), so as to become a united RFID label. The RFID label is conveyed in a state of having a surface thereof stuck on the label conveying drum.

Further the present invention is provided with an object-to-affix conveying mechanism to convey a product as an object-to-affix of a label. For this, for example, a star wheel, having a holder for the product and rotating in a constant direction, or a conveyer is used. The object-to-affix conveying mechanism is disposed in a contiguous position with the label conveying drum. An RFID label conveyed from the label conveying drum and a product conveyed from the object-to-affix conveying mechanism contact with each other in this contiguous area, and then the RFID label is released from the label conveying drum so as to be affixed on the product.

Whereas eliminating a defective ID tag on a releasing member causes a problem that an ID tag is not supplied successively. As a result, since an area having no ID tag existing on the tag conveying drum (tag absent area) occurs, a rotational movement of the tag conveying drum at a constant speed prevents an ID tag from being adhered to a display label. The first solution for this problem is to provide with a mechanism to increase rotation speed of the tag conveying drum, when the tag absent area contacts with the display label, so as to forward the next ID tag earlier (rotation speed adjusting mechanism). In this method, supplying speeds of the ID tag and the display label are set to a constant. In an affixing apparatus applied with this method, especially in order to adhere an ID tag and a display label smoothly, a special mechanism is adopted. More specifically, a tag pressing member is provided inside the tag conveying drum, and an end portion of the tag pressing member is exposed within the tag sticking section so as to contact with the ID tag. The tag pressing member can be in two states, a protruding state having the end portion protruding from the drum surface, and a non-protruding state having the end portion approximately level with the drum surface. When the ID tag and the display label are contacted, the tag pressing member is turned to be in the protruding state, so as to press the ID tag against the display label. In case that the ID tag and the tag absent section are contacted, as explained above, the rotation speed of the tag conveying drum increases, and also the tag pressing member is turned to be in the non-protruding state.

The second solution for the above problem is a method to increase a winding up speed of the releasing member after a defective ID tag is eliminated on the releasing member. For example, in case that one defective ID tag is eliminated, the winding up speed is multiplied by two, and in case that two defective ID tags are eliminated successively, the winding up speed is multiplied by three. This enables to provide a non-defective ID tag to the tag conveying drum at a constant interval, so as that no tag absent section is formed on the tag conveying drum. In case of adopting this method, rotation speeds of the tag conveying drum and the label conveying drum are set to a constant.

The third solution for the above problem is to adjust a rotation speed of the tag conveying drum, by having a non-defective ID tag being stuck on the tag conveying drum and standing by, so as to synchronize with a display label to be adhered. More specifically, a rotation speed of the tag conveying drum can be set to one of the same as a winding up speed of the first releasing member, a rotation speed of the label conveying drum and nil. The winding up speed of the first releasing member and the rotation speed of the label conveying drum are set to a constant. When an ID tag is stuck on the tag sticking section and adhered on a display label, the rotation speed of the tag conveying drum is set to the same as that of the label conveying drum. This allows the ID tag to be adhered with the display label smoothly. After this, the rotation speed of the tag conveying drum is changed to the same as the winding up speed of the first releasing label. This allows the ID tag to be stuck on a tag sticking section smoothly. Then, this tag sticking section is stopped right before the contiguous area of the tag conveying drum and the label conveying drum, so as to be synchronized with the display label to be adhered. After that, the tag conveying drum starts to rotate according to the rotation speed of the label conveying drum. On the other hand, in case that a defective ID tag is eliminated on the releasing member, an ID tag is not supplied on the tag sticking section as supposed to, and a non-defective ID tag is supplied on another tag sticking section subsequent to this tag sticking section. For example, in case that one defective ID tag is eliminated, a non-defective ID tag is supplied on a tag sticking section which is one tag sticking section after and, in case that two defective ID tags are eliminated successively, a non-defective ID tag is supplied on a tag sticking section which is two tag sticking sections after. Then, this tag sticking section is stopped in the contiguous area of the tag conveying drum and the label conveying drum. That is, substantially the standing-by position of the tag conveying drum changes.

Also, the fourth solution for the above problem is to pull out an object-to-affix having no RFID label affixed on the way of production line. An RFID label is to be affixed again to the object-to-affix pulled out. More specifically, an object-to-affix eliminating mechanism and a control device (a micro-computer or the like is used) controlling the object-to-affix eliminating mechanism and a label supplying mechanism are provided. Also, a winding up speed of the releasing member, a rotation speed of the tag conveying drum and a conveying speed of the object-to-affix are set to a constant. In case that eliminating a defective ID tag on the releasing member causes a tag absent area having no ID tag existing on a tag sticking section, in order to prevent the display label from contacting with the tag absent area, supply of the corresponding display label is stopped. That is, when the display label corresponding to the tag absent area is supplied, the control device sends a supply stop signal to the label supplying mechanism. This prevents forming of an RFID label, and causes an area having nothing stuck to (label absent area) on the label conveying drum. The label absent area contacts with an object-to-affix, resulting in that no RFID label is affixed on the object-to-affix. Therefore, it is necessary to pull out this object-to-affix on the way.

Also, another configuration of an affixing apparatus of an RFID label relating to the present invention is configured, wherein:

ID tags, including an antenna coil and an IC chip so as to transmit information to and from an external device through non-contact communication, is prepared in a sheet-fed form; and a plurality of display labels, having a display section on a front surface thereof and a adhesive surface on a back surface thereof, are aligned on a tape-shaped releasing member through adhesive, comprising:

(a) a tag supplying mechanism supplying said ID tags in a sheet-fed order;

(b) a label supplying mechanism supplying said display label;

(c) a writing mechanism writing predetermined information on said ID tag;

(d) a testing mechanism applying a reading test on the written information;

(e) a defective eliminating mechanism eliminating the ID tag distinguished as defective by said testing mechanism (f) a printing mechanism printing additional display on a predetermined position of said display label;

(g) a tag selecting drum sticking said ID tag supplied by said tag supplying mechanism, conveying said ID tag by rotation thereof and applying the information writing, the reading test and the defective elimination during transfer, so as to select a non-defective ID tag;

(h)a tag conveying drum, positioned so as that a rotation axis thereof is in parallel with that of said tag selecting drum and also that a surface thereof is contiguous with that of said tag selecting drum therefore in a contiguous area with said tag selecting drum said non-defective ID tag is released from said tag selecting drum and then transferred to a drum surface thereof having a plurality of tag sticking sections sticking said non-defective ID tag thereon, conveying said non-detective ID tag by rotation thereof;

(i) a label conveying drum, positioned so as that a rotation axis thereof is in parallel with that of said tag conveying drum and also that a surface thereof is contiguous with that of said tag conveying drum, sticking the printed display label supplied by said label supplying mechanism on a surface thereof and conveying said display label by rotation thereof and (j) an object-to-affix conveying mechanism, positioned so as to be contiguous with said label conveying drum, conveying an object-to-affix of said display label and said ID tag, wherein:

in a contiguous area of said tag conveying drum and said label conveying drum, said non-defective ID tag is released from said tag conveying drum and then affixed to the adhesive surface of said display label, so as to form an RFID label united of the printed display label and the non-defective ID tag, and then said RFID label is conveyed having the display label side thereof stuck to said label conveying drum; and in a contiguous area of said object-to-affix conveying mechanism and said label conveying drum said RFID label is released from said label conveying drum and then affixed to said object-to-affix.

An individual ID tag can be prepared in a sheet-fed form. In this case, a mechanism to array ID tag on a unified side and in a unified direction and also to supply the arrayed ID tag is required. This can be realized by using so-called parts feeder.

Inside of the above parts feeder, writing procedure, a testing procedure and defective eliminating procedure can be conducted, but it is usually difficult due to constraint of the device. Therefore, it is necessary to conduct the above procedures outside of the parts feeder. However, a tag conveying drum sometimes increases its rotation speed since an ID tag is not supplied successively, and thus operates irregularly. It is difficult to conduct the writing procedure or the like on the tag conveying mechanism operating irregularly. Therefore, in case that the parts feeder is used, it is preferable to provide with a drum that rotates at a constant speed, and being capable of conducting the writing procedure, the reading test procedure and the elimination procedure of the ID tag (tag selecting drum).

Even when the parts feeder is used, a problem, that a non-defective ID tag can not be supplied successively to the tag conveying drum, occurs similarly to the case that an ID tag is supplied using a releasing member. As a solution for this, it is possible to adopt the above mentioned first to fourth solutions. For example, while in the third solution mentioned above, the rotation speed of the label conveying drum is set to the same as the winding up speed of the first releasing member, it can be set to the same as the rotation speed of the tag selecting drum instead. Also, while in the fourth solution mentioned above the winding up speed of the first releasing member is set to a constant, the rotation speed of the tag selecting drum can be set to a constant instead.

According to the above explained affixing apparatus, an ID tag and a display label are separated so as that printing additional display on the display label would not cause damage to the ID tag. Also, a test of the ID tag is not conducted right before affixing to a product, so as to realize cost reduction by omitting adjustment operations such as a testing process, elimination of a defective ID tag, re-connection of a roll or the like in an ID tag manufacturing factory.

BEST MODES FOR CARRYING OUT THE INVENTION

Best modes for carrying out the present invention will be explained using figures, as follows.

Figure 1:
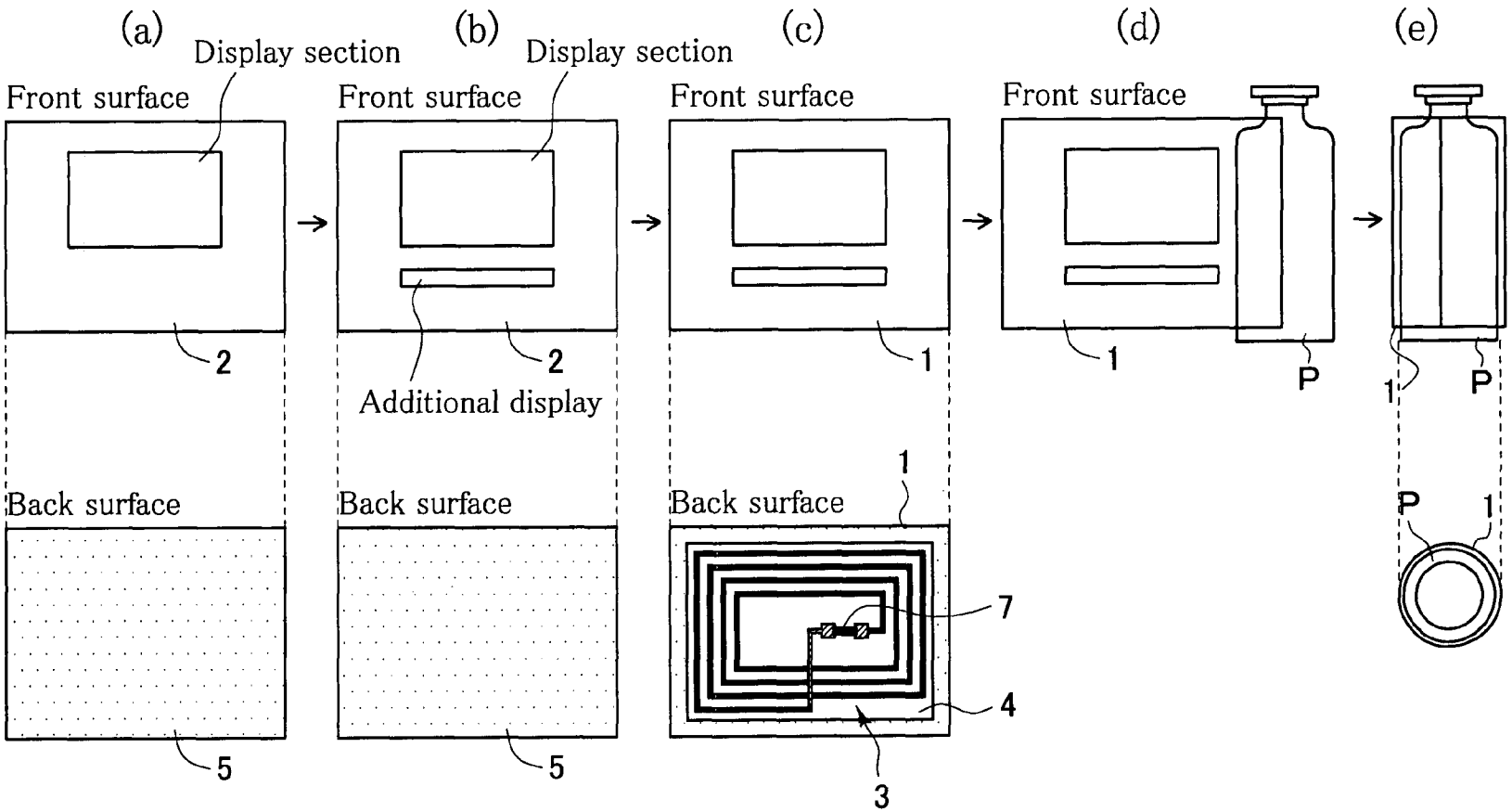
FIG. 1 is a schematic drawing showing an affixing method of an RFID label relating to the present invention.

A schematic drawing of an affixing method of an RFID label relating to the present invention is shown in FIG. 1. First, as shown in FIG. 1(*a*),a display label 2, provided with a display section thereof but having no additional display, is prepared. On its surface information such as a product name, a manufacturer name, components or the like is printed out, and adhesive 5 is applied on its back surface as a adhesive layer to a product and an ID tag. Next, as shown in FIG. 1(*b*), on the surface, additional display of information such as date of manufacture, expiry date or the like is printed out. Meanwhile, not shown in a figure, on an IC chip built in an ID tag, information such as a product name, date of manufacture, a lot number or the like is written, the information is checked by applying a reading test, and then a defective ID tag, for which reading can not be applied, is eliminated. Thereafter, as shown in FIG. 1(*c*), a non-defective ID tag 3 having readable information is affixed on a back surface of the display label 2, so as to form an RFID label 1 having them united. In addition, not shown in a figure, it is also allowed to affix a double-sided adhesive tape or apply adhesive to the affixed ID tag 3, so as to improve adhesiveness to a product. As explained above, after forming the RFID label 1, as shown is FIGS. 1(*d*) and (*e*), the RFID label 1 is affixed to an object-to-affix P.

Referring FIG. 2, an affixing apparatus of an RFID label related to the present invention will be explained next. An ID tag 3 is supplied from a tag supplying mechanism TS to a tag conveying drum 8, and a display label 2 is supplied from a label supplying mechanism LS to a label conveying drum 9. These drums rotate in the direction of the arrow in the figure, and according to the rotation, the ID tag 3 and the display label 2 are conveyed. The tag conveying drum 8 and the label conveying drum 9 are disposed so as that their rotation axes are parallel and also that their surfaces are contiguous.

Figure 2:
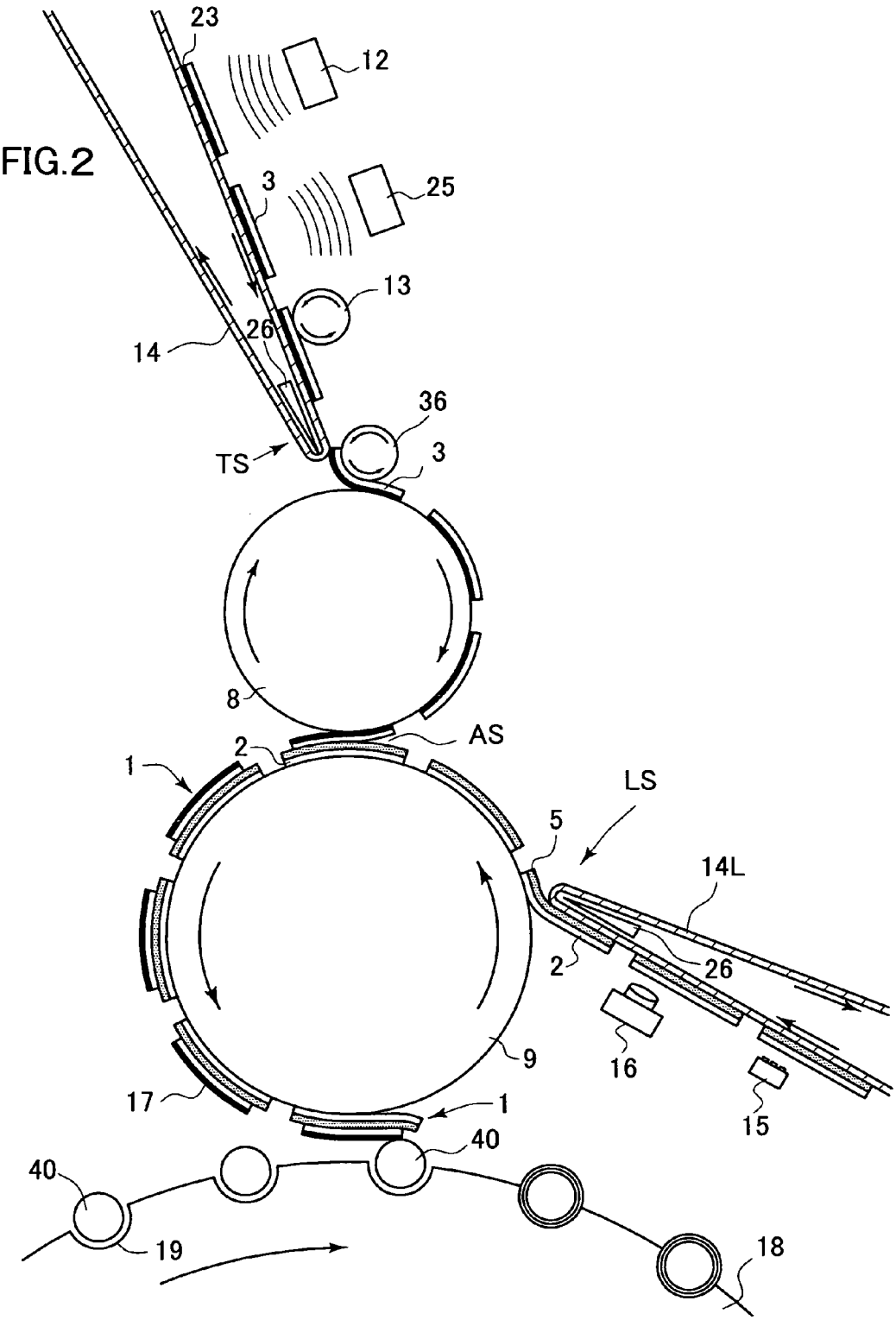
FIG. 2 is a drawing showing an embodiment of an affixing apparatus of an RFID label.

In an embodiment of FIG. 2, the ID tag 3 is prepared in a state of being affixed to a tape-shaped releasing member 14. By winding up the releasing member 14 in a direction of the arrow and bending a panel 26 at a sharp angle right before the tag conveying drum 8, the ID tag 3 is released by itself, and then conveyed to the tag conveying drum 8, so as that adhesive 23 contacts with a drum surface of the tag conveying drum 8. Also, by a pressure bonding member 36 the ID tag 3 is stuck on the drum surface.

Figure 4A:
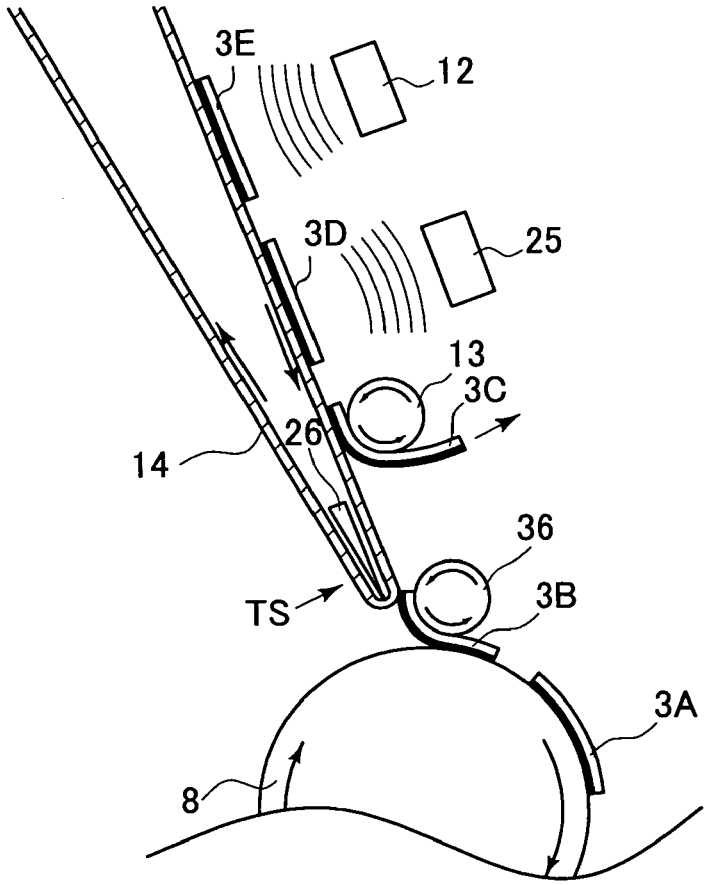
FIG. 4A is a drawing explaining the second solution.

Writing and a reading test to an ID tag 3 are conducted on a releasing member 14. That is, a writing mechanism 12 writes predetermined information by sending electric wave, and a testing mechanism 25 applies a reading test to the information. A defective eliminating mechanism 13, as shown in FIG. 4A, eliminates an ID tag distinguished as defect. More precisely the defective eliminating mechanism 13 is a drum rotating in the direction of the arrow, and provided with a negative pressure device, so as that the ID tag 3 is stuck on the drum surface by using the negative pressure. In case that the ID tag 3 is distinguished as non-defective, it is not stuck, however in case that it is distinguished as defective, it is stuck as shown in FIG. 4A, so as to eliminate the defective ID tag in the direction of the arrow.

Figure 3A:
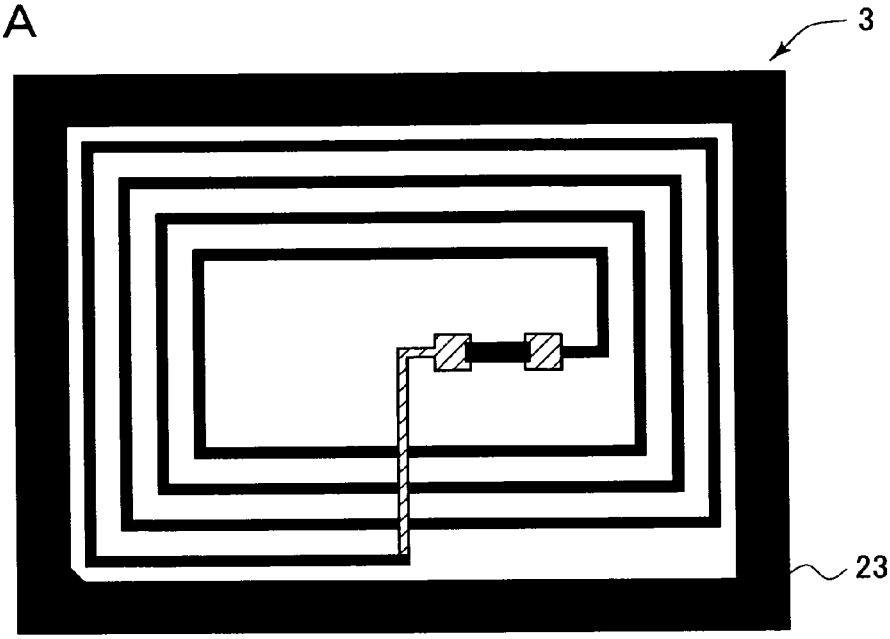
FIG. 3A is a drawing showing an embodiment of an ID tag.
Figure 3B:
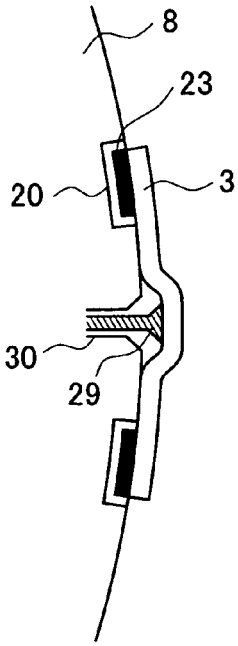
FIG. 3B is a magnified drawing showing essential parts of the first embodiment of a tag conveying drum.

Adhesive 23 on an ID tag 3 is applied either only on a peripheral part (FIG. 3A) or on an entire surface (not shown) thereof. In case that the adhesive 23 is adhered on the drum surface too strong, the ID tag 3 can not be released. In order to prevent such a problem, as shown in FIG. 3B, it is preferable to form a concave portion 20 only where the adhesive 23 exists on the drum surface, so as that only a part where no adhesive 23 exists on the ID tag 3 can contact with the drum surface. Alternatively in case that the adhesive 23 is adhered on the entire surface of the ID tag 3, as shown in FIG. 3C, it is preferable to apply an anti-adhesive processing such as a silicon processing on the drum surface.

Figure 3C:
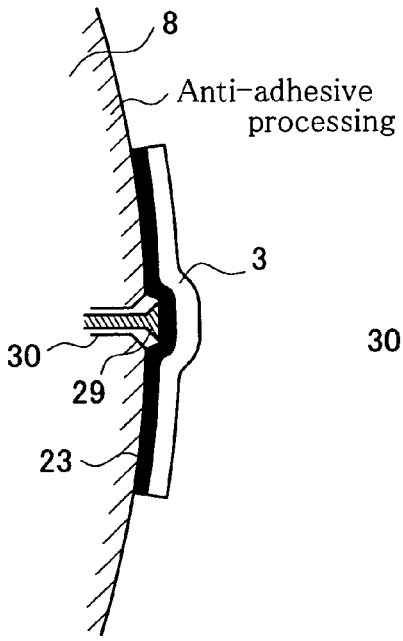
FIG. 3C is a magnified drawing showing essential parts of the second embodiment of a tag conveying drum.
Figure 3D:
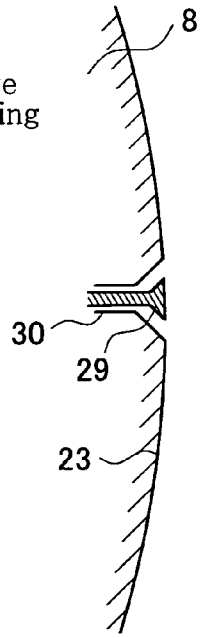
FIG. 3D is a magnified drawing showing essential parts of the third embodiment of a tag conveying drum.

Oh the other hand, as shown in FIGS. 3B to 3D, it is allowed to provide the tag conveying drum 8 with a tag pressing member 29 inside thereof. An end portion of the tag pressing member 29 is exposed within a tag sticking section, so as to contact with the ID tag 3. It is also allowed for the tag pressing member 29 to take two states, a protruding state having the end portion protruding from the drum surface (FIG. 3B and FIG. 3C) and a non-protruding state having the end portion positioned approximately level with the drum surface (FIG. 3D). Alternatively, FIG. 3B shows that the adhesive 23 does not contact with the drum surface, and in order to stick the ID tag 3 in this state, it is also allowed to make the tag pressing member 29 hollow so as to connect to a negative pressure device, not shown. Thus it is possible to stick the ID tag 3 by negative pressure in the tag pressing member 29.

Now it will be discussed regarding FIG. 2 again. On a supplying side of the display label 2, a supplying method using a releasing member is adopted. As shown in FIG. 2, A releasing member 14L is bent at a sharp angle right before the label conveying drum 9. Then the display label 2 is released from the releasing member 14L, and then conveyed to the label conveying drum 9. Adhesive 5 is applied on the display label 2, and the display label 2 is provided so as to prevent the adhesive 5 from contacting with a drum surface of the label conveying drum 9. It is allowed to provide the conveying drum 9 with a sticking mechanism using a negative pressure device so as to stick the display label 2 on the drum surface.

Additional display on the display label is printed by a printing mechanism 15. The printing method can be, for example, printing under pressing force, printing by pressing hot types, printing by laser or the like. As shown in FIG. 2, the printing can be conducted on the releasing member 14L. Conventionally an ID tag is already affixed on a display label when additional display is printed, thus pressure or heat by printing can affect to damage the ID tag. However the present invention prints additional display only on a display label, so as to prevent a damage of an ID tag. In order to check if the printing is conducted properly, an additional display checking mechanism 16 is provided.

A tested ID tag 3 supplied from the tag conveying drum 8 and a display label 2, having additional display printed, supplied from the label conveying drum 9 are contacted in a contiguous area AS of the drums. The ID tag 3 is released from the tag conveying drum 8 and then affixed to the display label 2 here, so as to form an RFID label 1 having them united. The RFID label 1 is conveyed in a state of being stuck on the label conveying drum 9. Though not shown in FIG. 2, the tag conveying drum 8 is provided with the above tag pressing member 29, and in the contiguous area AS the pressing member 29 is in the protruding state. Therefore, for example as shown in FIG. 3B, the ID tag 3 is partly lifted up from the drum surface, so as to allow easier pressing against the display label.

On the other hand, an object-to-affix 40 to the label is conveyed by an object-to-affix conveying mechanism. As the object-to-affix conveying mechanism, as shown in FIG. 2, a star wheel 18, having a holder 19 for the object-to-affix 40 and rotating and conveying in the direction of the arrow, can be preferably used. The object-to-affix conveying mechanism and the label conveying drum 9 are disposed at a contiguous position, and the RFID label 1 is affixed on the object-to-affix 40. Rotation speeds of the label conveying drum 8 and the wheel are approximately equal and synchronized in order to affix the RFID label 1 smoothly to the objects-to-affix 40 conveyed continuously.

Elimination of a defective ID tag causes a discontinuous supply of the ID tag 3, thus an area having no ID tag existing (tag absent area) can occur on a tag sticking section. When this area contacts with the display label 2, no ID tag is affixed to the display label 2. In order to solve this problem, there are first to fourth embodiments. First, the first solution embodiment will be explained. In FIG. 2, a rotation speed adjusting mechanism (not shown) is provided, so as to adjust a rotation speed of the tag conveying drum 8. By this mechanism, the tag conveying drum 8 is rotated fast so as to forward the next ID tag. More specifically, the rotating speed is multiplied by an integer, for example, in case that one defective ID tag is eliminated, the rotation speed of the tag conveying drum 8 is multiplied by two, or in case that two defective ID tags are successively eliminated, the rotation speed of the tag conveying drum 8 is multiplied by three. A control device such as a microcomputer enables this operation. In case that a defective ID tag is detected, a checking mechanism 25 sends a signal to the control device, and then the control device recognizes, by this signal and the rotation speed of the drum, when the section having no defective ID tag, which have been eliminated, approaches to the contiguous area AS. At that instant, the control device sends a signal so as to increase the rotation speed of the tag conveying drum 8.

Figure 16A:
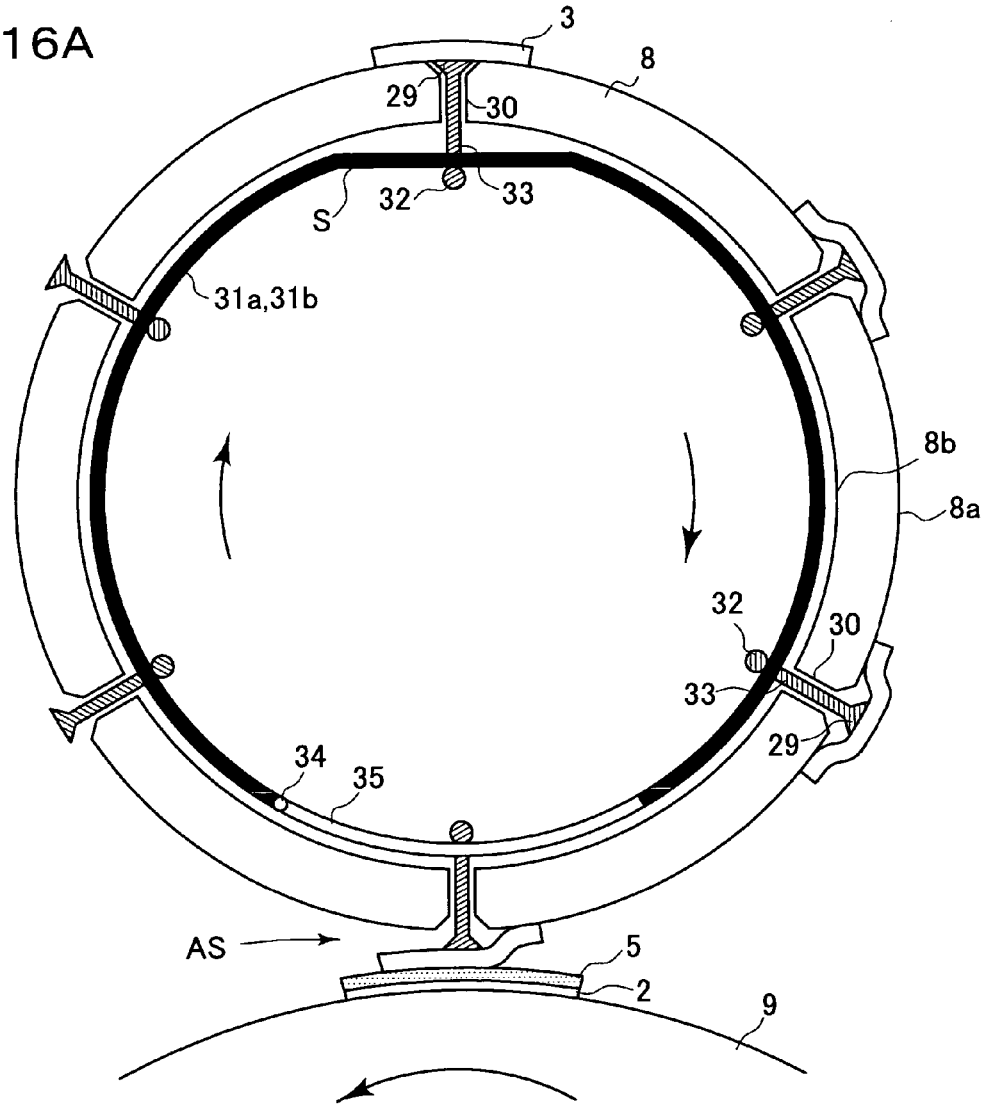
FIG. 16A is a sectional drawing showing an inner structure of a tag conveying drum.
Figure 16B:
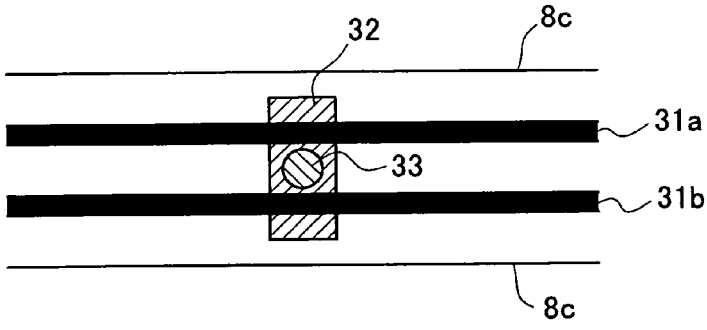
FIG. 16B is a magnified drawing showing essential parts of a tag conveying drum from the drum surface side.
Figure 17:
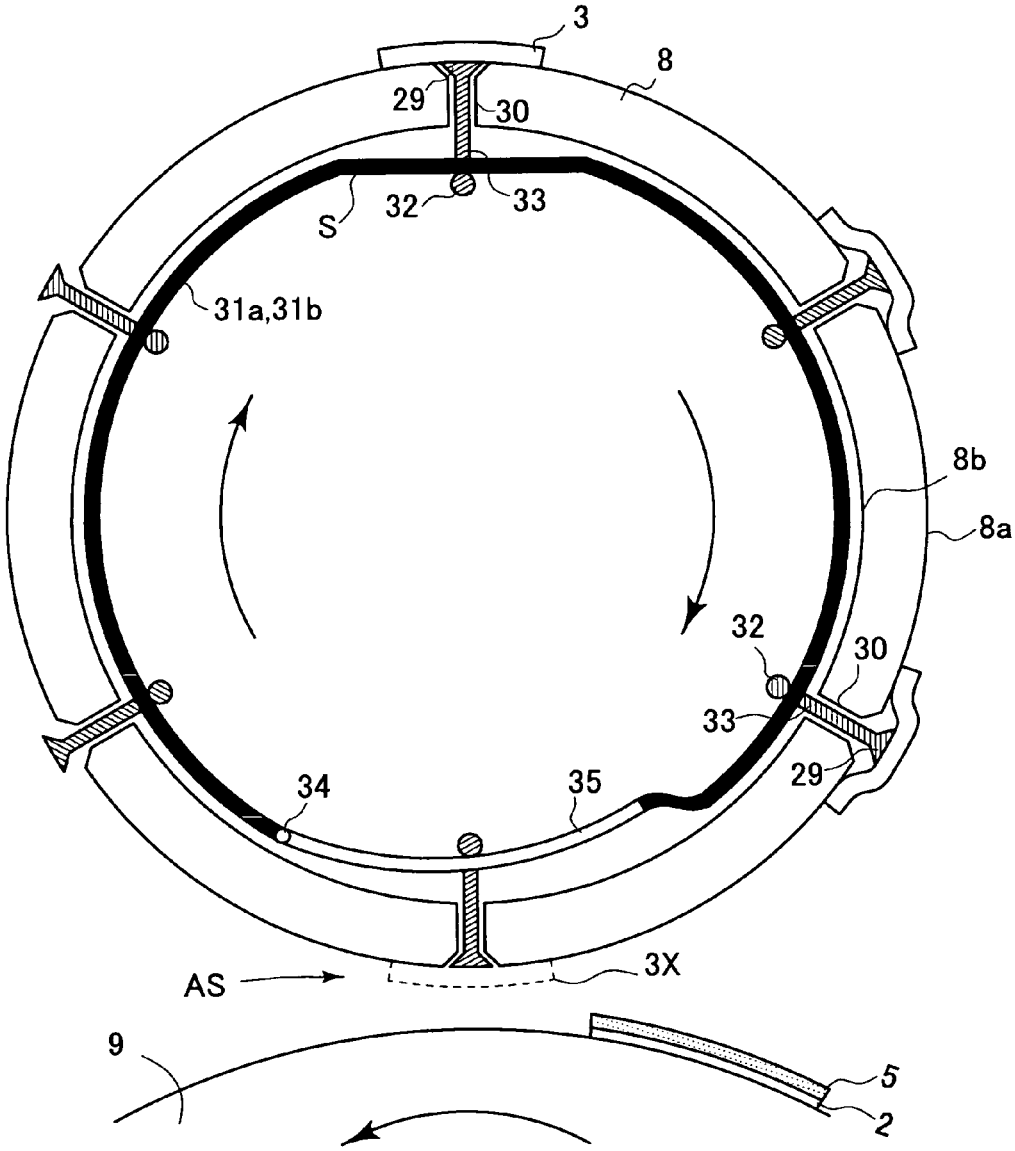
FIG. 17 is a sectional drawing of a tag conveying drum showing actions in case that a tag absent area occurs.

However, only increasing the rotation speed results in that the tag pressing member 29 contacts with the label conveying drum. Thus the tag pressing member 29 can be pulled down so as that the height thereof is approximately level with the drum surface (the non-protruding state). FIGS. 16A, 16B and 17 show mechanisms capable of the above procedure. FIG. 16A is a sectional drawing showing an inner structure of the tag conveying drum 8, and FIG. 16B is a drawing showing a part thereof from the drum surface side. In the tag conveying drum 8, a drum penetrating hole 30 is formed so as to penetrate through a drum surface 8*a* and a drum inner surface 8*b*, and the tag pressing member 29 is disposed inside of the drum penetrating hole 30. Rails 31*a* and 31*b* are formed along the drum inner surface 8*b*, and fixed in a predetermined direction so as to prevent them from being displaced according to rotation of the drum. A position adjusting member 32 is disposed inside of the rails 31*a* and 31*b*, and the position adjusting member 32 and the tag pressing member 29 are connected with a connecting member 33. The tag pressing member 29, the connecting member 33 and the position adjusting member 32 rotate according to rotation of the drum, and pressed to outside with a predetermined pressure by, for example, a spring (not shown in a figure). As shown in FIG. 16B, the rails 31*a* and 31*b* are disposed parallel with a drum side surface 8*c*, and the connecting member 33 runs between the two rails. This structure enables the position adjusting member 32 to move rotationally having constant contact with inner surfaces of the rails 31*a* and 31*b*. On the other hand, a movable support 34 and a movable rail 35 are disposed on the contiguous area AS side with the label conveying drum. The movable support 34 is provided with an electrical power generator such as solenoid, and this power can move the movable rail 35 to a center direction. In case that an ID tag 3 exists on the tag pressing member 29, as shown in FIG. 16A, the movable rail 35 is positioned along the drum inner surface 8*b*. This allows the tag pressing member 29 near the contiguous area AS to be in a state of being protruding from the drum surface 8*a* (the protruding state).

In case that an ID tag 3 does not exist on the tag pressing member 29 (in case that the ID tag 3 is regarded as defective and removed), as shown in FIG. 17, the movable rail 35 is lifted up by movement of the movable support 34. The rails 31*a* and 31*b* are made of an elastic material such as rubber so as to connect with the movable rail 35 smoothly. This allows the tag pressing member 29 to be positioned approximately level with the drum surface 8*a* (the non-protruding state).

On the side where the ID tag 3 is supplied (upper sides in FIGS. 16 and 17), the tag pressing member 29 is turned to the non-protruding state. The reason is because it is difficult to supply an ID tag 3 in the protruding state. In order to turn to the non-protruding state, the rails 31*a* and 31*b* are disposed slightly distanced from the drum inner surface 8*b* on the ID tag supplying side (S area in FIG. 16 and FIG. 17).

Figure 4B:
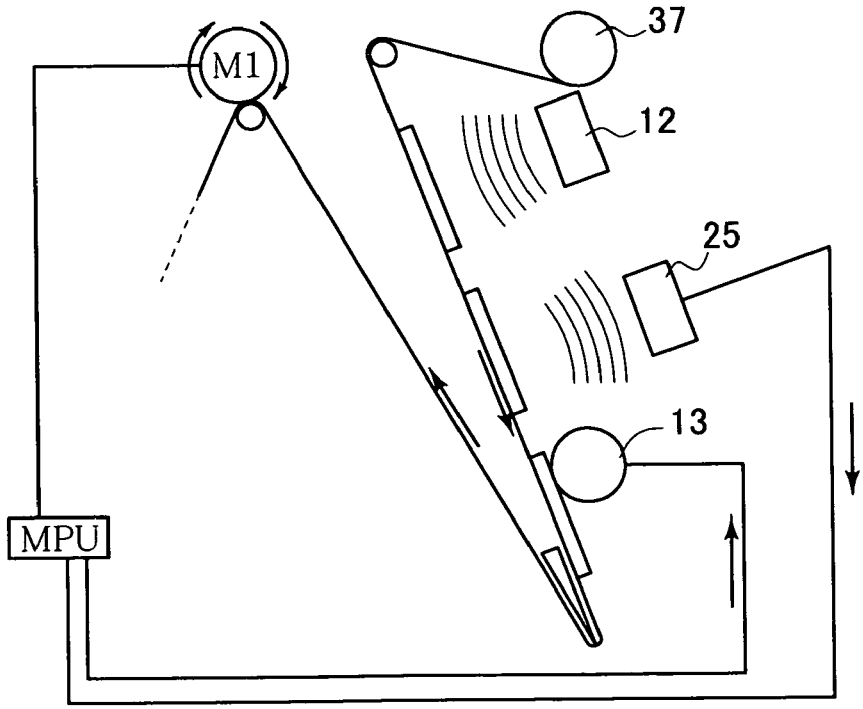
FIG. 4B is a magnified drawing of FIG. 4A.

Next, using FIGS. 4A and 4B, the second solution embodiment will be explained. The tag conveying drum 8 rotates at a predetermined speed, and an ID tag 3A is stuck on a drum surface thereof and conveyed. An ID tag 3B is halfway through sticking. Further ID tags are provided from the releasing member 14. In this area an ID tag 3C is distinguished as defective, and then eliminated by the defective eliminating mechanism 13. In this case, if winding up speed of the releasing member 14 is constant, ID tags can not be supplied at a constant interval to the tag conveying drum. Therefore by multiplying the winding up speed of the releasing member 14 by two, an ID tag 3D to be supplied next is supplied subsequent to the ID tag 3B. FIG. 4B shows schematically a control method of a motor M1 (a motor winding up the releasing member 14). The releasing member 14 is prepared as a roll 37, and the one end thereof is winded up by the motor M1. In case that a defective ID tag is not detected, the motor M1 rotates at a constant speed (standard speed). In case that a defective ID tag is detected, the checking mechanism 25 sends a signal to a control device MPU. Upon receiving this signal, the MPU sends a signal for sticking when the defective ID tag comes to the defective eliminating mechanism 13. Next the MPU increases rotation speed of the motor M1. More specifically it is allowed to adopt a method such as, by using a stepping motor as the motor M1, to multiply pulse frequency sent from M1 by two, or the like.

Figure 5:
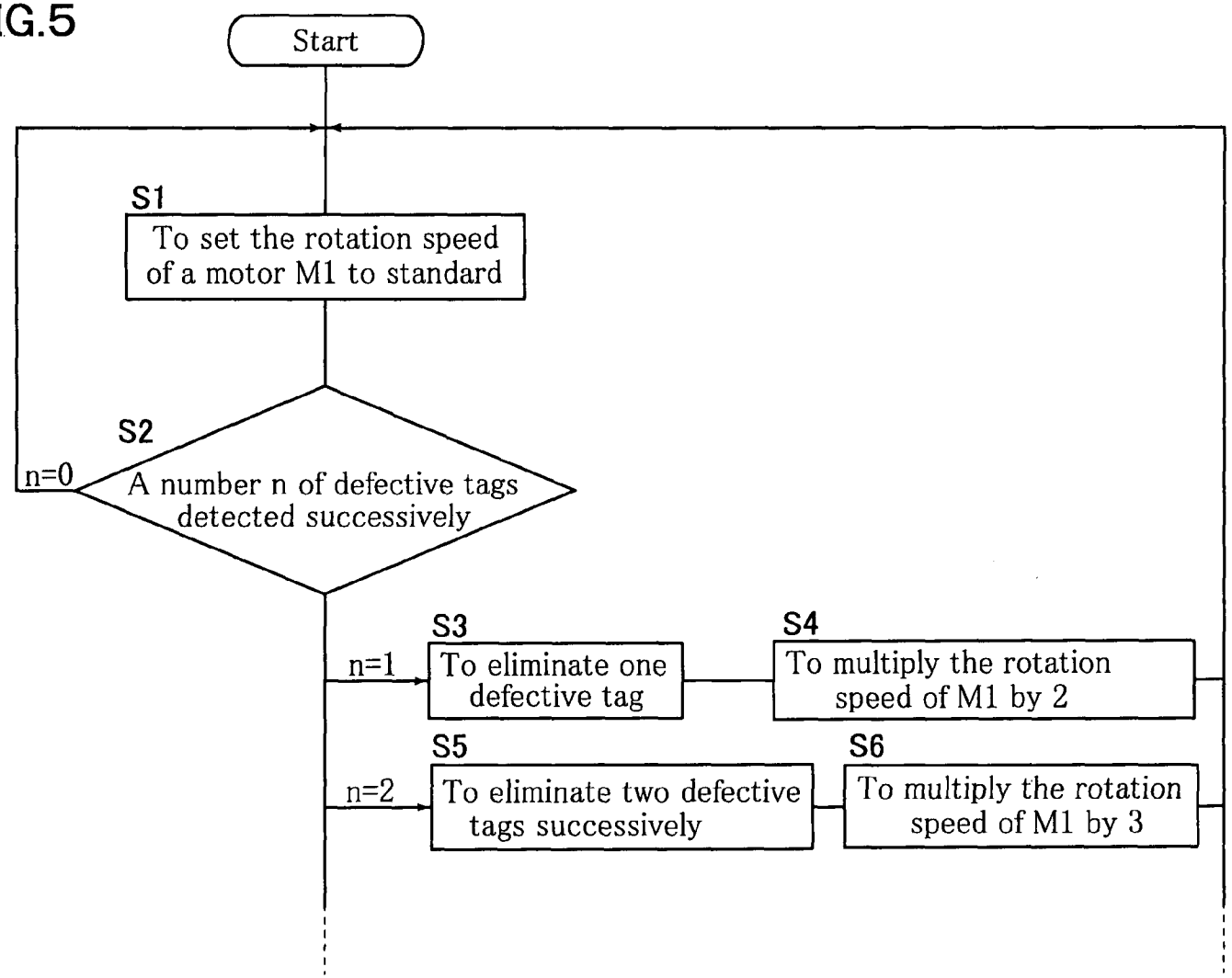
FIG. 5 is a drawing showing an example of a flow chart of a control device.

By using a flow chart in FIG. 5, actions of the MPU will be explained. Usually a step procedure S1 is implemented so as to set a rotation speed of the motor M1 to the standard speed. Then, it proceeds to a step procedure S2, so as to recognize a number n of defective tags detected successively. In case that n is one, it proceeds to a step procedure S3, so as to send the defective eliminating mechanism 13 a signal to eliminate one defective ID tag. And then, a step procedure S4 is implemented, so as to send the motor M1 a signal to multiply the rotation speed by two. In case that n is two, similarly it proceeds to step procedures S5 and S6. It is also allowed to enable to deal with a case that three or more defective ID tags are detected successively.

Figure 6:
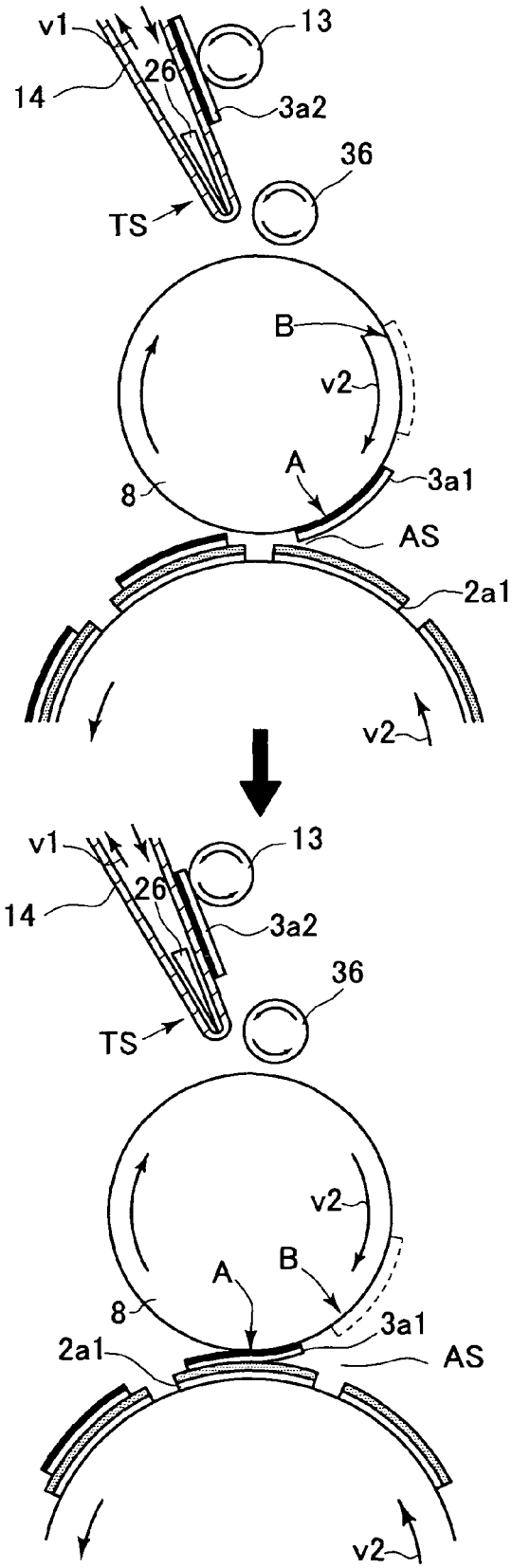
FIG. 6 is a drawing explaining the third solution.
Figure 7:
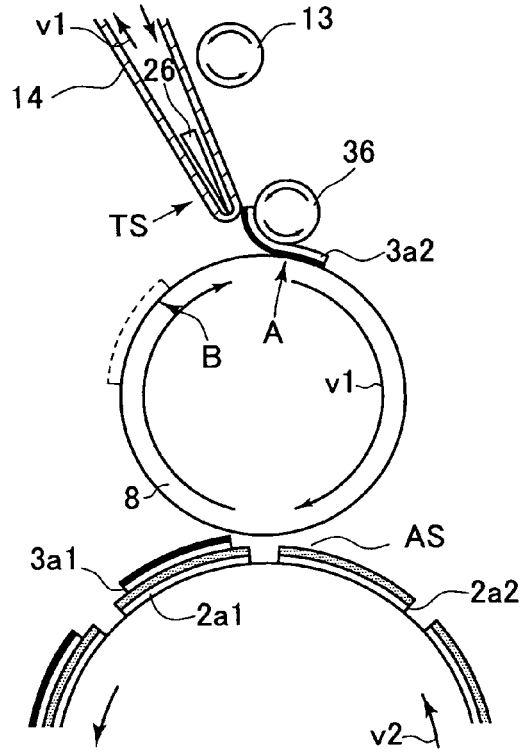
FIG. 7 is a drawing continued from FIG. 6.
Figure 7:
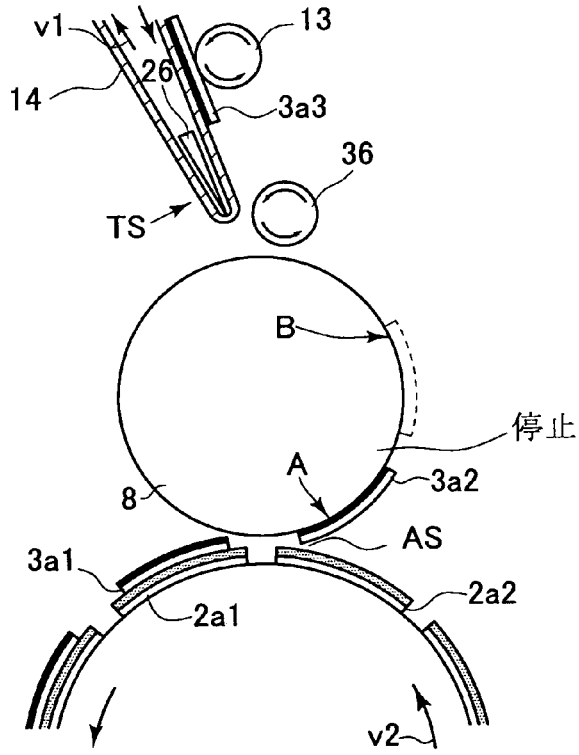
Figure 8:
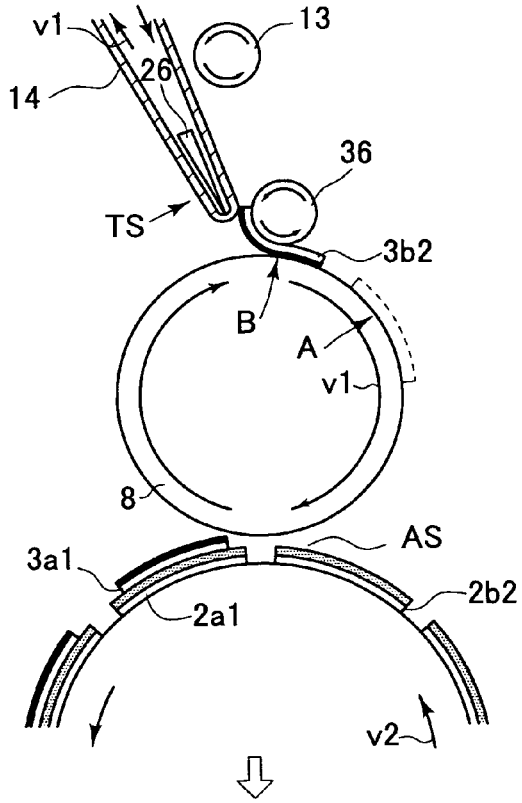
FIG. 8 is a drawing continued from FIG. 7.
Figure 8:
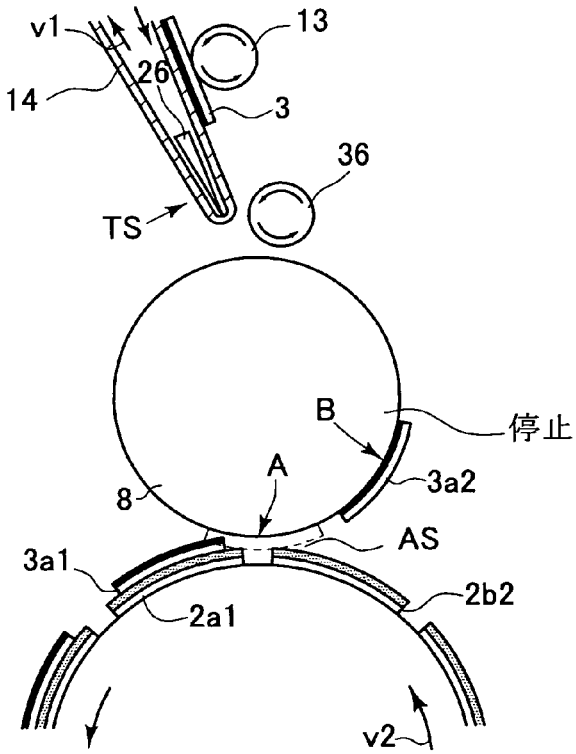

Using FIGS. 6 to 8, the third solution embodiment will be explained. In this method, a winding up speed v1 of the releasing member 14 and a rotation speed v2 of the label conveying drum 8 are always constant. A rotation speed of the tag conveying drum can be set to one of v1, v2 and nil. In a state 1 (FIG. 6), on a drum surface of the label conveying drum 8, tag sticking sections A and B are formed, and an ID tag 3*a*1 is stuck on the tag sticking section A. At this point, as the rotation speed of the tag conveying drum 8 is set to v2, the ID tag 3*a*1 can be adhered smoothly to a display label 2*a*1. Upon completion of the adhesion, the rotation speed of the tag conveying drum 8 is set to the same as v1 (the winding up speed of the releasing member 14), and the tag sticking section A is transferred around the pressure bonding member 36. At this point, a next ID tag 3*a*2 is stuck on the tag sticking section A (a state 2). After that, the tag conveying drum 8 continuously rotates, and then stops right before the contiguous area AS (a state 3). The tag conveying drum 8 is synchronized by stopping, so as to affix the ID tag 3*a*2 to a display label 2*a*2, and then starts to rotate at a rotation speed v2 again (return to the state 1). In case that a defective ID tag is eliminated on the releasing member 14, it turns to a state 2' or a state 3'. As shown in FIG. 8, in case that one defective ID tag is eliminated, no ID tag gets on the tag sticking section A, but a next non-defective ID tag 3*b*2 gets on the tag sticking section B (the state 2'). That is, the tag sticking section A turns to be a tag absent area having no ID tag existing. Then, in the state 3', the stop position of the tag conveying drum 8 is changed, so as that the tag sticking section B stands by right before the contiguous area AS. While FIG. 6 to FIG. 8 show an example that two tag sticking sections A and B are formed on the drum surface, it is also allowed to provide with three or more tag sticking sections. For example, providing with three tag sticking sections enables to deal with a case that two defective ID tags are detected successively.

Figure 9:
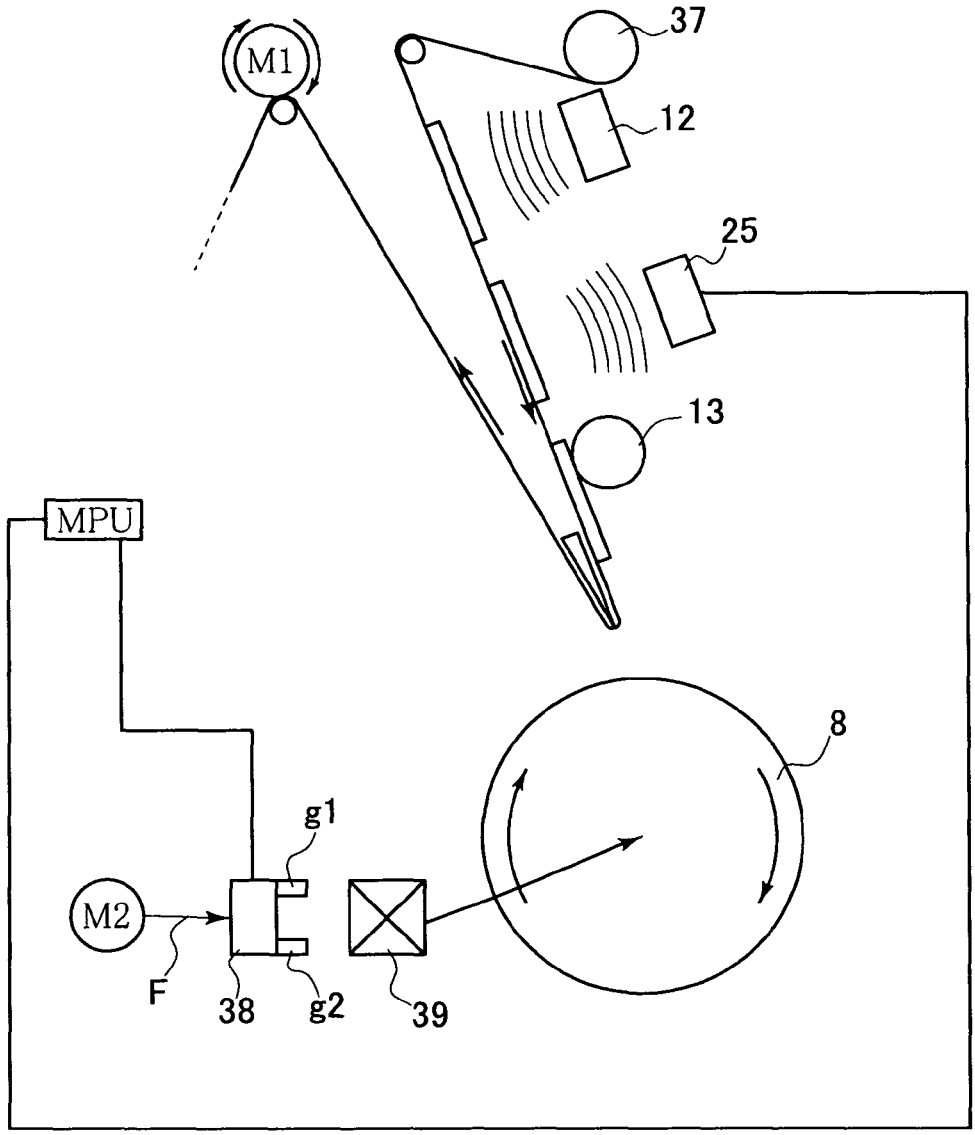
FIG. 9 is a schematic drawing showing the third solution.

Electrical and mechanical control, in order to realize the third solution embodiment explained above, will be explained, using a schematic drawing in FIG. 9. The tag conveying drum 8 rotates by transfer of rotation force F of a motor M2. A gear main body 38 and a clutch 39 are disposed between the motor M2 and the tag conveying drum 8, and the gear main body 38 is provided with a gear g1 to change a rotation speed of the tag conveying drum 8 to v1, and a gear g2 to change it to v2. Connection between these gears g1 and g2 and the clutch 39 is controlled by the MPU. A neutral state having the clutch 39 connected to neither the gears g1 or g2 stops rotation of the drum. In case that no defective ID tag is detected, by control of the MPU, connection to the gears g1 and g2 and a neutral state are repeated at specific time intervals. In case that a defective ID tag is detected, the MPU controls connection to the gears g1 and g2, so as to turn to a state 2' and a state 3', as shown in FIG. 8. Also, though not shown in a figure, other than a method using the gears g1 and g2 and the clutch, it is allowed to adopt a method controlling a rotation speed of the motor M2 by changing pulse frequency from the MPU by using a stepping motor as the motor M2.

Figure 10:
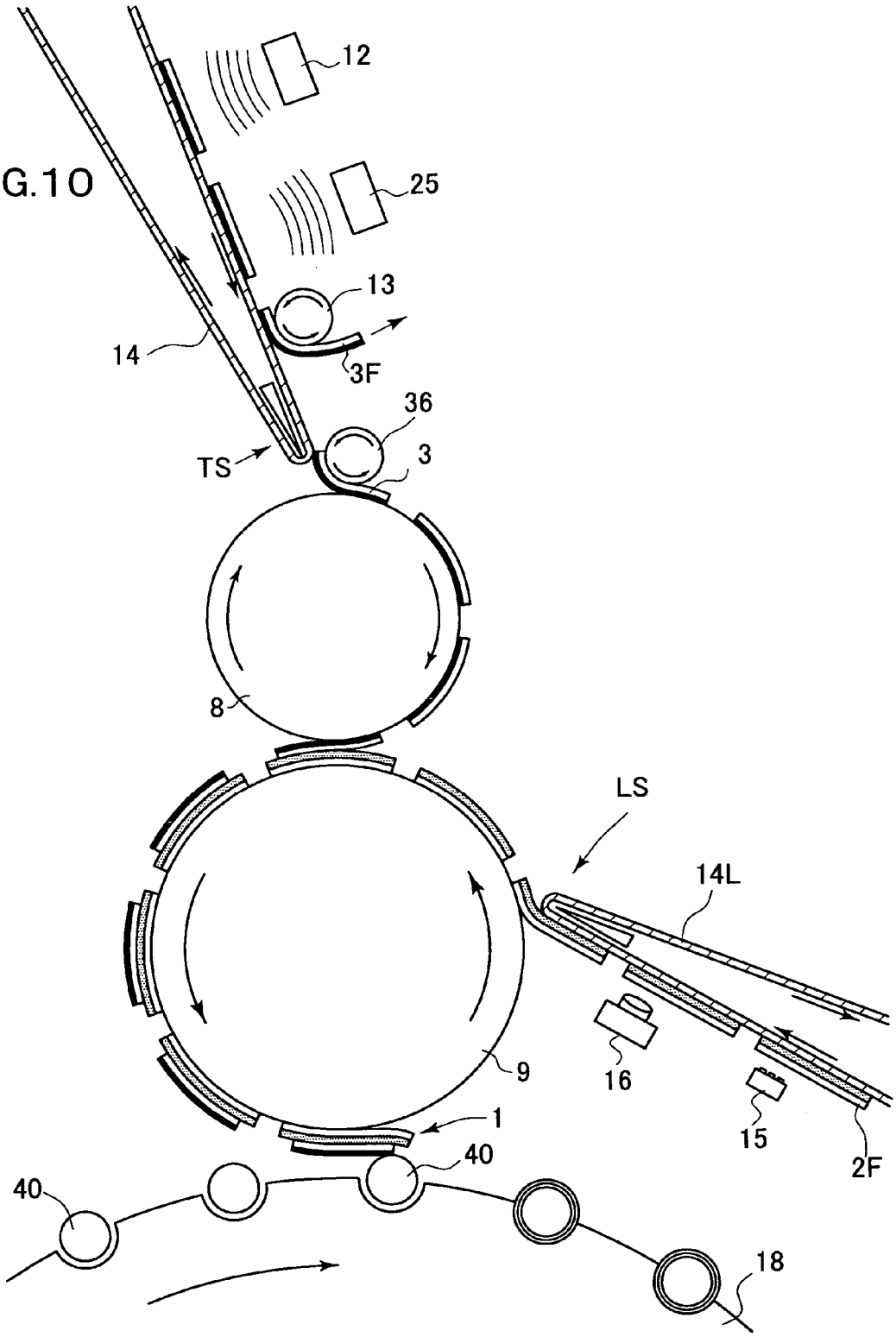
FIG. 10 is a drawing explaining the fourth solution.
Figure 11:
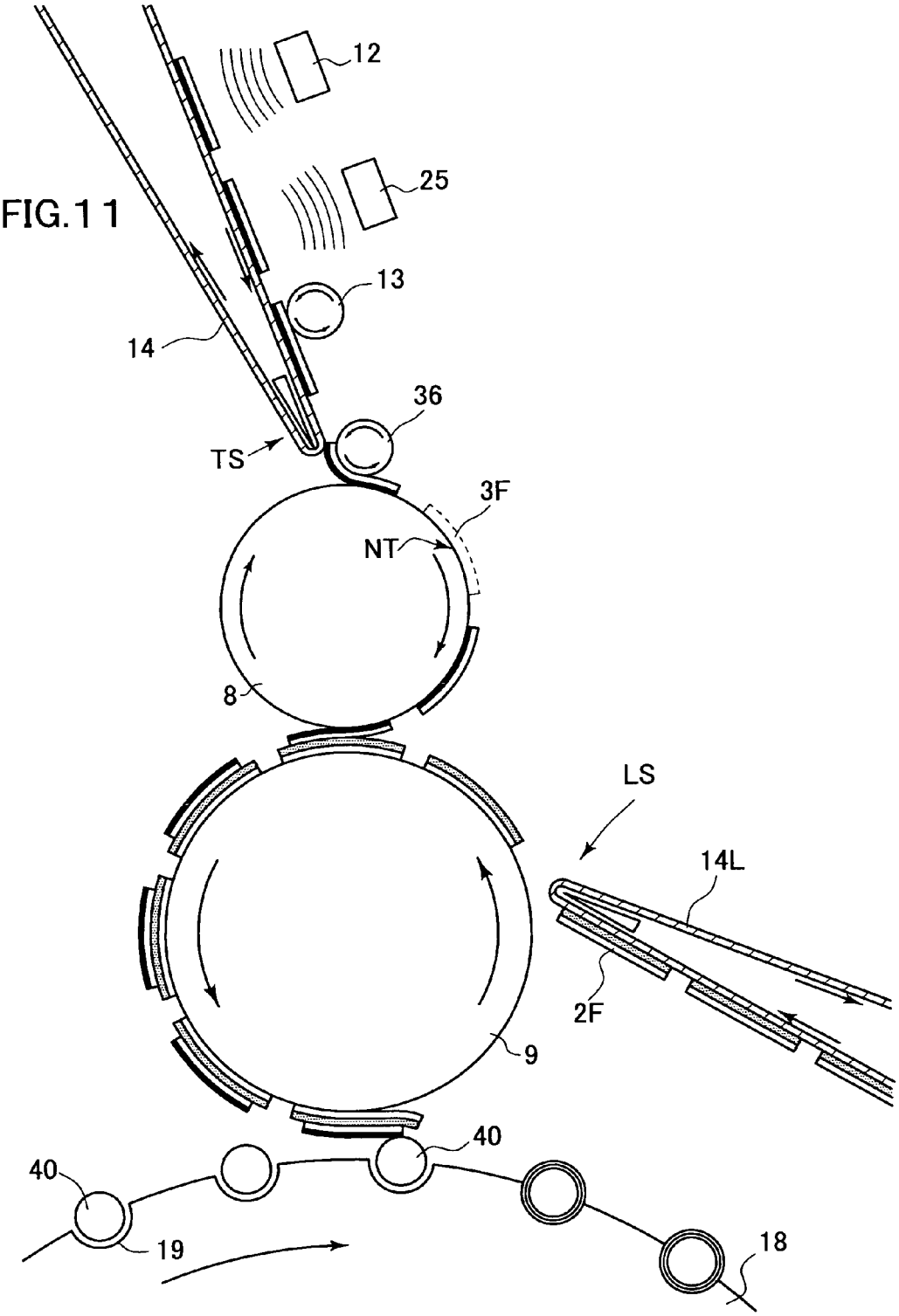
FIG. 11 is a drawing continued from FIG. 10.
Figure 12:
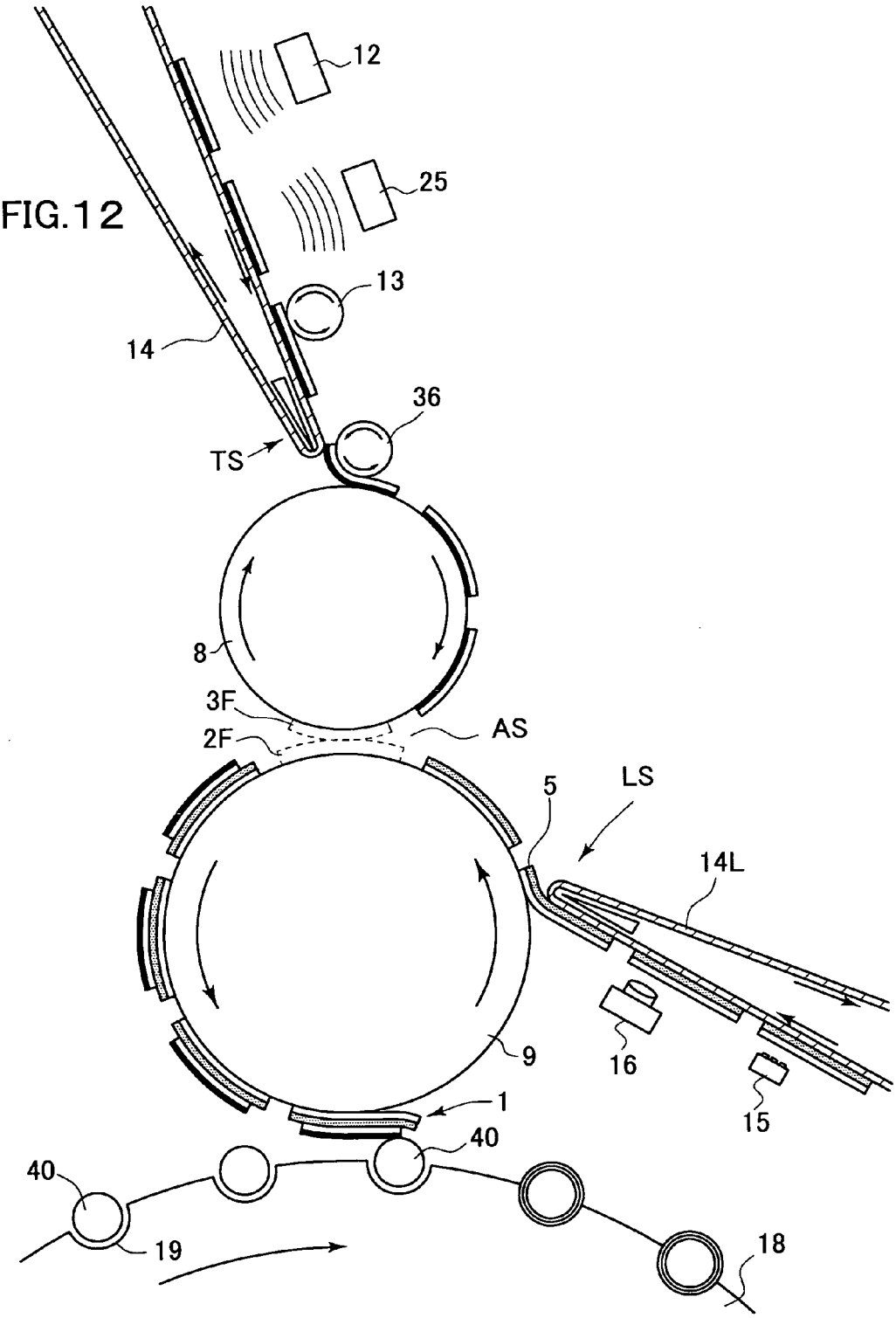
FIG. 12 is a drawing continued from FIG. 11.

Using FIGS. 10 to 12, the fourth solution embodiment will be explained next. In this embodiment, a winding up speed of the releasing member 14 and rotation speeds of the tag conveying drum 8, the label conveying drum 9 and the star wheel 18 are consistently constant. An object-to-affix eliminating mechanism, not shown, is also provided. Further, a control device MPU (FIG. 13) is provided, so as to control a label supplying mechanism LS and the object-to-affix eliminating mechanism. For example, in FIG. 10, in case that an ID tag 3F is removed as defective, a display label 2F,to which the ID rag 3F is to be affixed, exists on the releasing member 14L (a second releasing member). FIG. 11 shows a state that an ID tag 3, a display label 2 and an objects-to-affix 40 are transferred for a space of two thereof. When the display label 2F is supplied to the label conveying drum 9, a signal from the control device MPU stops the label supplying mechanism LS temporarily. Then the label supplying mechanism LS starts again after providing with a space for one display label. Further, FIG. 12 shows a state entirely moved for a space of two portions. No ID tag 3F or display label 2F exists in the contiguous area AS, so that no RFID label 1 is formed. Continued rotation in this state results in forming an object-to-affix 40 having no RFID label 1 affixed to, however it is removed by the above mentioned object-to-affix eliminating mechanism. Time to remove is determined by the control device MPU from information, provided when the checking mechanism 25 detects a defective ID tag.

Figure 13:
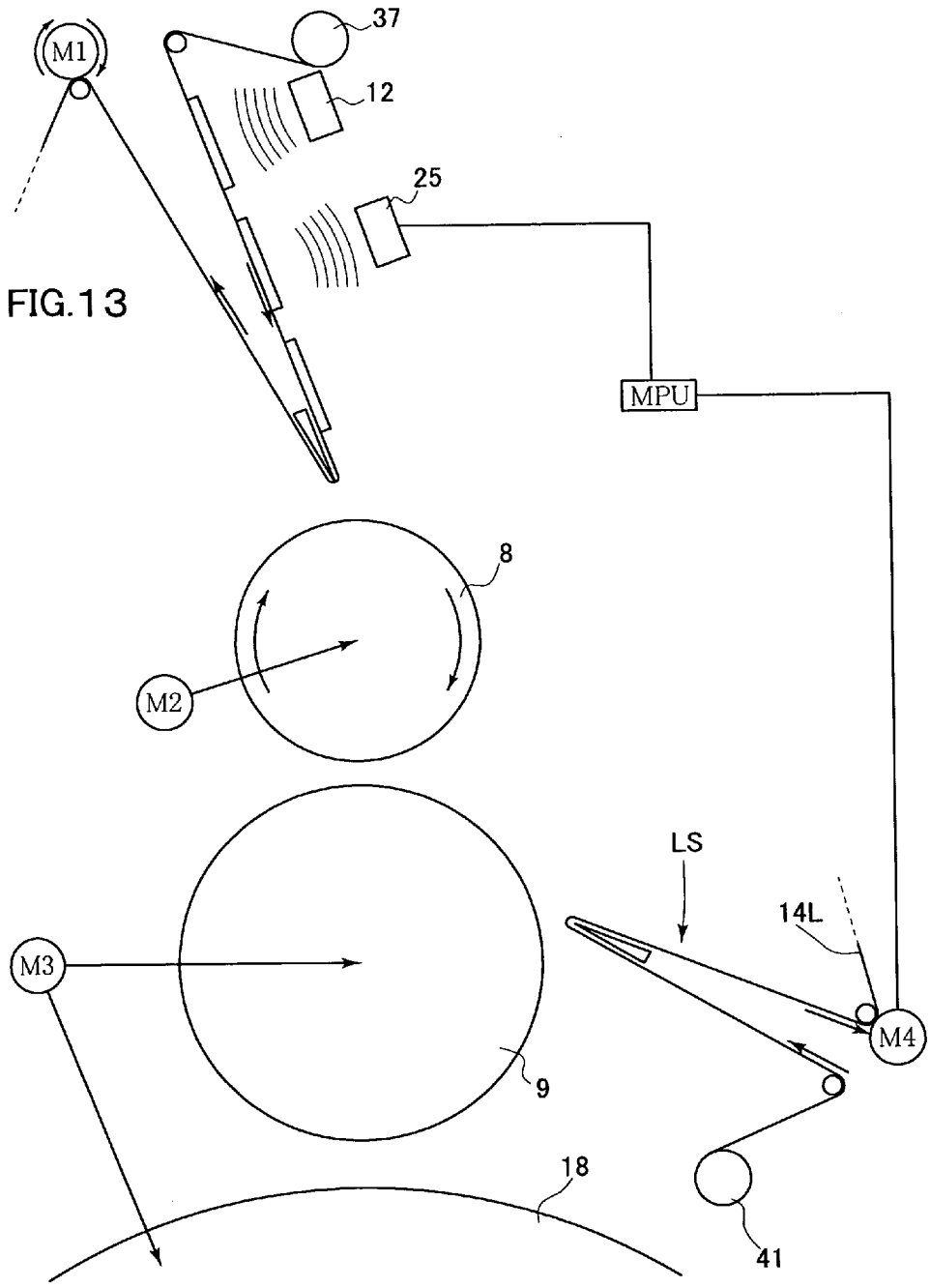
FIG. 13 is a schematic drawing showing the fourth solution.

It will be explained regarding FIG. 13, next. The label supplying mechanism LS has the same mechanism as the tag supplying mechanism TS, and supplies a display label 2 by using the tape-shaped releasing member 14L. The releasing member 14L is winded up by a motor M4, and the motor M4 is controlled by the MPU. When a defective is detected by the checking mechanism 25, the MPU sends a stop signal to the motor M4. This stops supplying a display label 2 temporarily.

Figure 14:
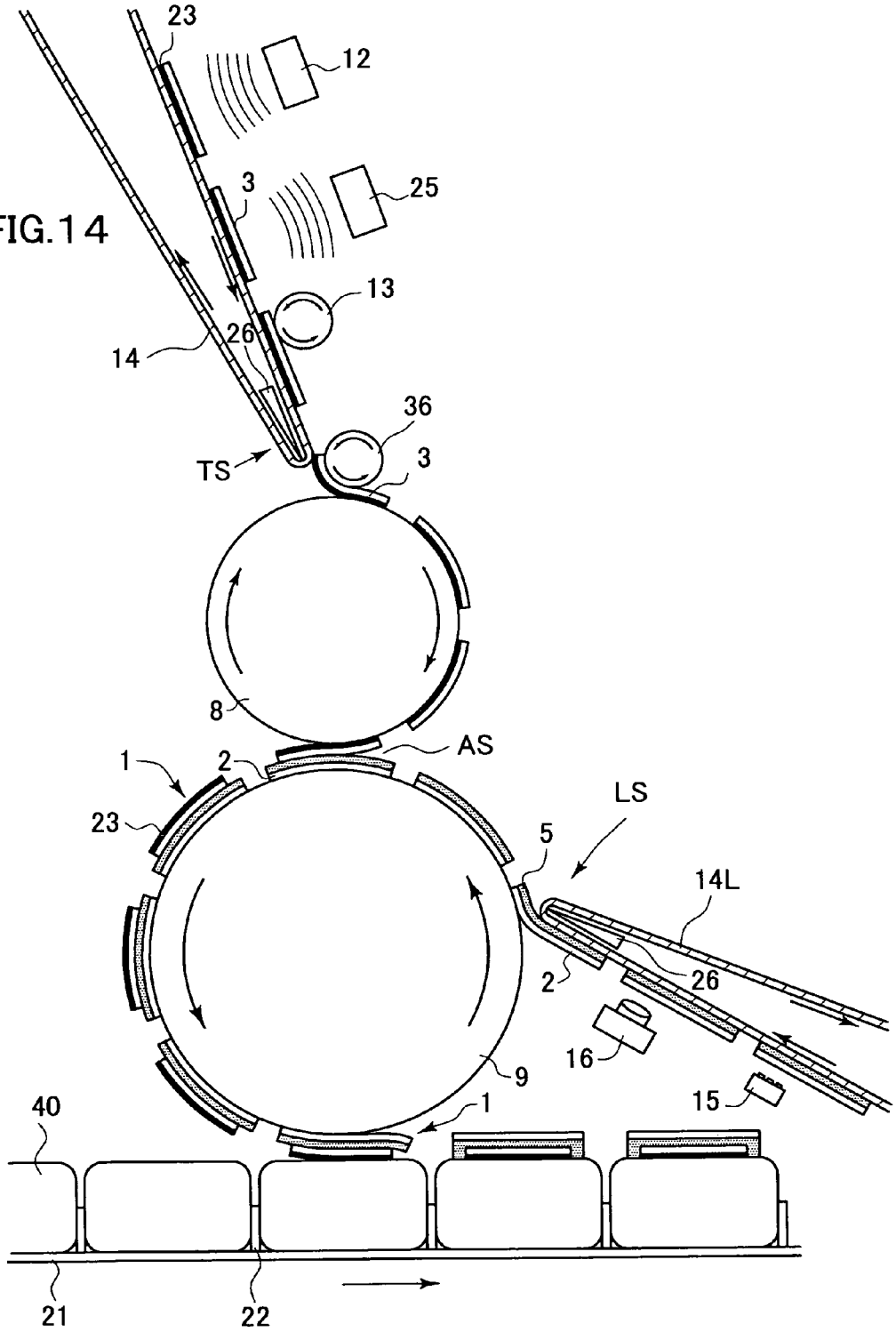
FIG. 14 is a drawing showing an embodiment using a conveyer.

An embodiment in FIG. 14 will be explained next. The present invention, as shown in FIG. 14, is allowed to use a conveyer 21 as an object-to-affix conveying mechanism. The conveyer has a holder 22 formed notch-shaped in order to hold a object-to-affix 40, so as to be capable of conveying the object-to affix 40 at a constant speed. A speed of the conveyer 21 is set to the same as the rotation speed of the label conveying drum 9, and adjusted so as to affix an RFID label to the object-to-affix smoothly.

Figure 15:
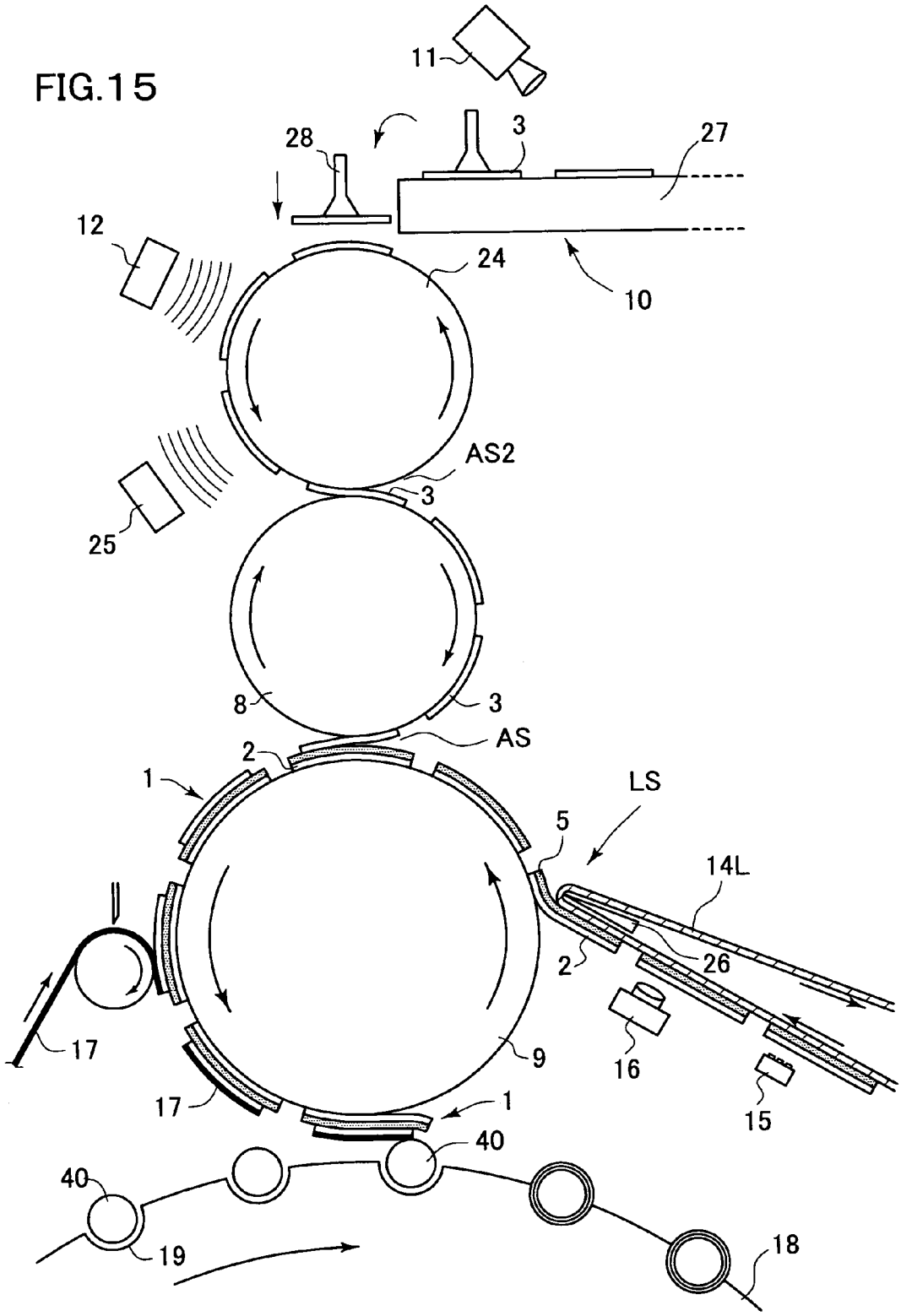
FIG. 15 is a drawing showing an embodiment using a parts feeder.

An embodiment in FIG. 15 will be explained next. In FIG. 15, a parts feeder 10 is used as the tag supplying mechanism TS supplying an ID tag 3. The parts feeder 10 is a device supplying an ID tag 3 arrayed in a sheet-fed form, and provided with a tag storage (not shown in a figure), an arraying plate 27 and a supplying hand 28. The ID tag 3 is sent from the tag storage to the arraying plate 27, and then vibrated so as to be arrayed in a predetermined direction. Next, the arrayed ID tag 3 is supplied with the supplying hand 28. An ID tag 3 being not arrayed or upside-down is distinguished by a camera 11 and sent back to the tag storage.

Figure 19A:
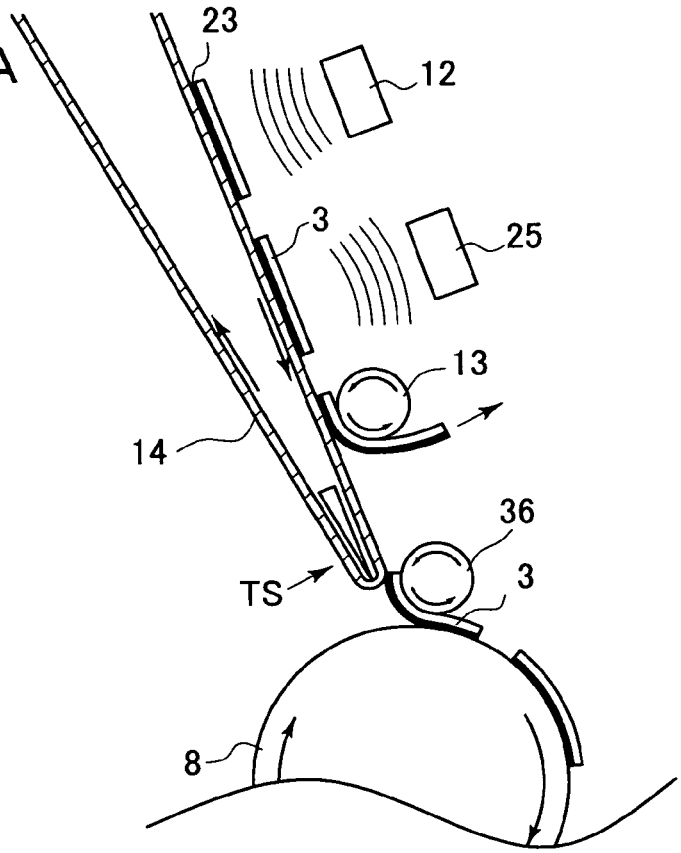
FIG. 19A is a drawing showing a method of eliminating a defective ID tag in FIGS. 2 and 4.
Figure 19B:
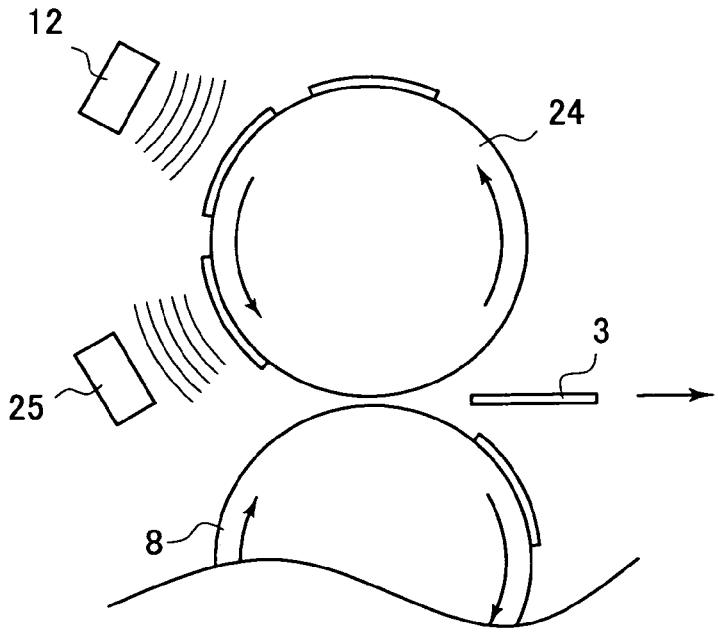
FIG. 19B is a drawing showing a method of eliminating a defective ID tag in FIG. 5.
Figure 20A:
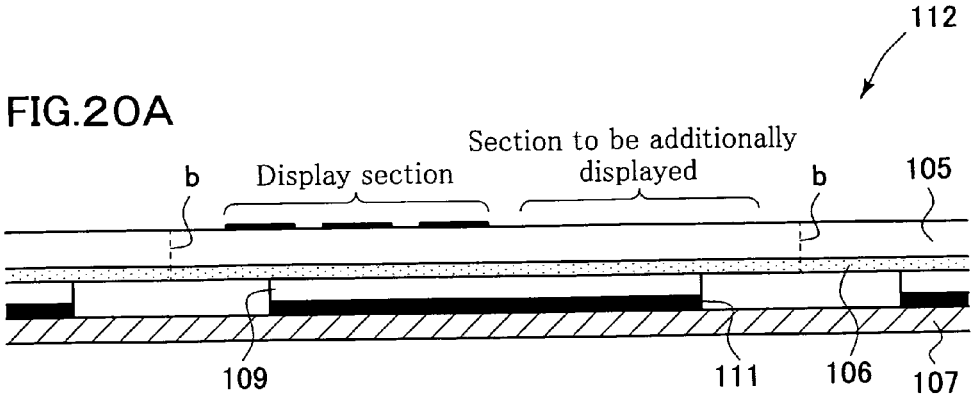
FIG. 20A is a sectional drawing of a conventional RFID label.
Figure 20B:
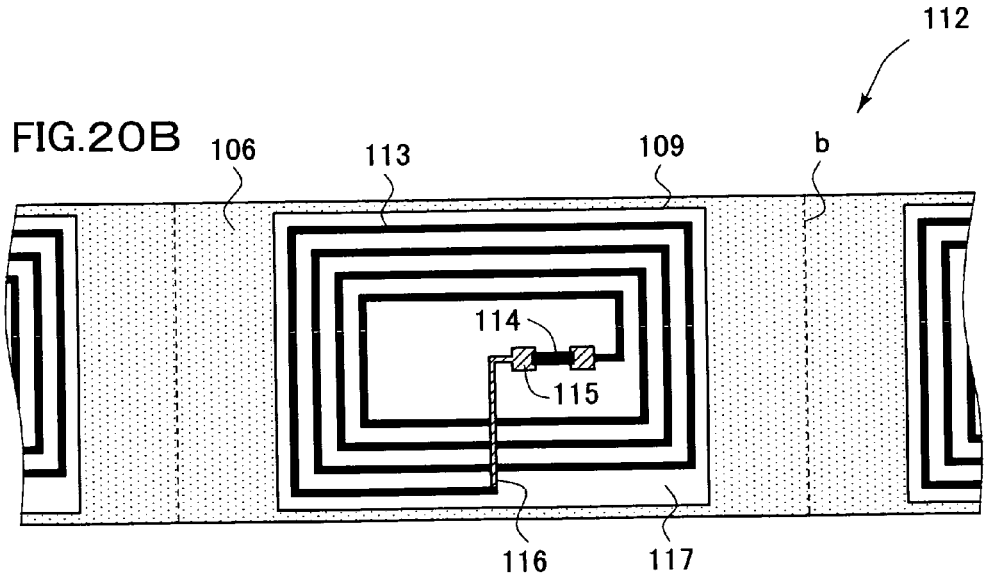
FIG. 20B is a surface drawing of a conventional RFID label.

A tag selecting drum 24 is provided in FIG. 15. The tag selecting drum 24 rotates in the direction of the arrow at a constant speed so as to convey an ID tag 3. The writing mechanism 12 and the checking mechanism 25 are disposed on a conveying way of the ID tag 3. The tag selecting drum 24 is disposed so as that a rotation axis thereof is parallel with that of the tag conveying mechanism 8 and also a drum surface thereof is contiguous with that of the tag conveying drum 8. A non-defective ID tag is, in a contiguous area AS2, sandwiched between the two drums, released from the tag selecting drum 24, and then conveyed to the tag conveying drum 8. Inside of the tag selecting drum 24, a negative pressure device is provided so as to give negative pressure inside of a hole formed on the drum surface, and the ID tag 3 supplied on the hole is stuck with negative pressure. Level of this sticking power is controllable and, in case that the ID tag 3 is non-defective, the sticking power is set weaker so as to convey the ID tag 3 to the tag conveying drum easily. In case of defective, the sticking power is set stronger to be approximately the same as the sticking power on the tag conveying drum side. This eliminates a defective ID tag in the direction of the arrow as shown in FIG. 19B. That is, in the embodiment of FIG. 15, a sticking power control mechanism of the tag selecting drum is regarded as the defective eliminating mechanism.

As mentioned above, emergence of a defective ir-regulates rotation movement of the tag conveying drum 8. Therefore if a writing procedure, a checking procedure and defective eliminating procedure were to be conducted on the tag conveying drum 8, irregular rotation movements would prevent these procedures from being conducted at precise timing. In FIG. 15, since these procedures are conducted on the tag selecting drum 24 rotating at a constant speed, the above problem is less likely to occur.

In FIG. 15, a double-sided tape 17 is adhered to the ID tag 3 affixed on a back surface of the RFID tag 1. This enlarges area of an adhesive surface to the object-to-affix 40, so as to improve adhesive strength. Other than using the double-sided tape as shown in FIG. 15, it is also allowed to use a sticking material, adhesive or the like. In the embodiment using the tag selecting drum 24, by eliminating a defective ID tag, a problem of discontinuous supply of an ID tag 3 occurs. For this problem, as already explained, the first to the fourth solution embodiments can be adopted.

Figure 18A:
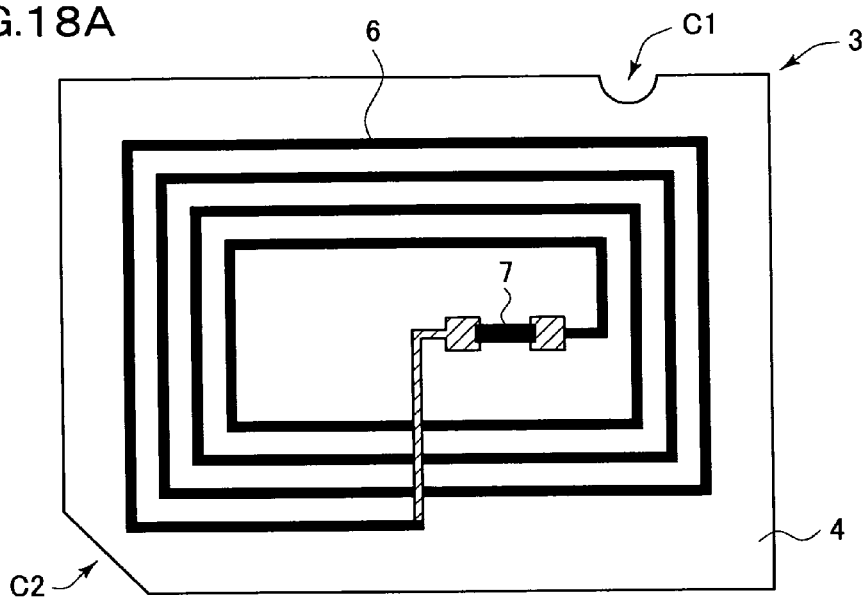
FIG. 18A is a drawing showing an embodiment of an ID tag used for a parts feeder.
Figure 18B:
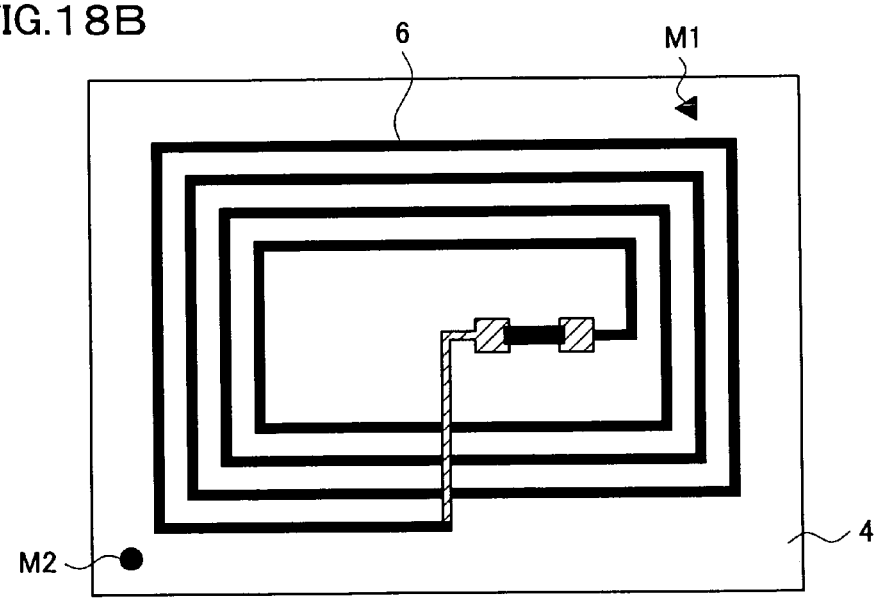
FIG. 18B is a drawing showing an embodiment of an ID tag used for a parts feeder.

It is preferable to form at least one incision on an ID tag 3, for example shown in FIG. 18A. This allows a camera 11 to distinguish back and front and a direction of the ID tag 3 easily on the parts feeder 10. In FIG. 18A, two incisions, a first incision C1 and a second incision C2, are formed on an insulated substrate 4. In an embodiment of FIG. 18B, two index marks, a first index mark M1 and a second index mark M2, are formed inside of the substrate 4. Only one index mark like these can be formed as long as it's possible to distinguish back and front and a direction of the ID tag 3. In order to produce an ID tag 3, a metal film such as aluminum foil or the like is placed on the substrate 4, resist-patterned using a photomask including pattern information of an antenna coil 6, and then etched. The photomask including pattern information of an index mark forms the index mark on the ID tag produced.

What is claimed is:

1. An affixing apparatus of an RFID label, wherein:

a plurality of ID tags, including an antenna coil and an IC chip so as to transmit information to and from an external device through non-contact communication, are prepared to be aligned on a tape-shaped first releasing member through adhesive; and a plurality of display labels, having a display section on a front surface thereof and a adhesive surface on a back surface thereof, are prepared to be aligned on a tape-shaped second releasing member through adhesive, comprising:

(a) a tag supplying mechanism supplying said ID tag by winding up said first releasing member;

(b) a label supplying mechanism supplying said display label by winding up said second releasing member;

(c) a writing mechanism writing predetermined information on said ID tag;

(d) a testing mechanism applying a reading test on the written information;

(e) a defective eliminating mechanism eliminating the ID tag distinguished as defective by said testing mechanism;

(f) a printing mechanism printing additional display on a predetermined position of said display label;

(g) a tag conveying drum having a plurality of tag sticking sections on a surface thereof so as to stick said non-defective ID tag supplied by said tag supplying mechanism, and conveying said non-detective ID tag by rotation thereof;

(h) a label conveying drum, positioned so as that a rotation axis thereof is in parallel with that of said tag conveying drum and also that a surface thereof is contiguous with that of said tag conveying drum, sticking the printed display label supplied by said label supplying mechanism on a surface thereof and conveying said display label by rotation thereof and (i) an object-to-affix conveying mechanism, positioned so as to be contiguous with said label conveying drum, conveying an object-to-affix of said display label and said ID tag, wherein:

said writing mechanism, said testing mechanism and said defective eliminating mechanism are positioned in approximately parallel with said first releasing member, respectively writing said information, applying said reading test and conducting said defective elimination during transfer of said ID tag according to winding up of the first releasing member, so as to supply only said non-defective tag to said tag conveying drum;

in a contiguous area of said tag conveying drum and said label conveying drum, said non-defective ID tag is released from said tag conveying drum and then affixed to the adhesive surface of said display label, so as to form an RFID label united of the printed display label and the non-defective ID tag, and then said RFID label is conveyed having the display label side thereof stuck to said label conveying drum; and in a contiguous area of said object-to-affix conveying mechanism and said label convey drum, said RFID label is released from said label convey drum and then affixed to said object-to-affix.

2. An affixing apparatus of an RFID label, wherein:

ID tags, including an antenna coil and an IC chip so as to transmit information to and from an external device through non-contact communication, is prepared in a sheet-fed form; and a plurality of display labels, having a display section on a front surface thereof and a adhesive surface on a back surface thereof, are aligned on a tape-shaped releasing member through adhesive, comprising:

(a) a tag supplying mechanism supplying said ID tags in a sheet-fed order;

(b) a label supplying mechanism supplying said display label;

(c) a writing mechanism writing predetermined information on said ID tag;

(d) a testing mechanism applying a reading test on the written information;

(e) a defective eliminating mechanism eliminating the ID tag distinguished as defective by said testing mechanism;

(f) a printing mechanism printing additional display on a predetermined position of said display label;

(g) a tag selecting drum sticking said ID tag supplied by said tag supplying mechanism, conveying said ID tag by rotation thereof and applying the information writing, the reading test and the defective elimination during transfer, so as to select a non-defective ID tag;

(h) a tag conveying drum, positioned so as that a rotation axis thereof is in parallel with that of said tag selecting drum and also that a surface thereof is contiguous with that of said tag selecting drum therefore in a contiguous area with said tag selecting drum said non-defective ID tag is released from said tag selecting drum and then transferred to a drum surface thereof having a plurality of tag sticking sections sticking said non-defective ID tag thereon, conveying said non-detective ID tag by rotation thereof;

(i) a label conveying drum, positioned so as that a rotation axis thereof is in parallel with that of said tag conveying drum and also that a surface thereof is contiguous with that of said tag conveying drum, sticking the printed display label supplied by said label supplying mechanism on a surface thereof and conveying said display label by rotation thereof; and (j) an object-to-affix conveying mechanism, positioned so as to be contiguous with said label conveying drum, conveying an object-to-affix of said display label and said ID tag, wherein:

in a contiguous area of said tag conveying drum and said label conveying drum, said non-defective ID tag is released from said tag conveying drum and then affixed to the adhesive surface of said display label, so as to form an RFID label united of the printed display label and the non-defective ID tag, and then said RFID label is conveyed having the display label side thereof stuck to said label conveying drum; and in a contiguous area of said object-to-affix conveying mechanism and said label conveying drum said RFID label is released from said label conveying drum and then affixed to said object-to-affix.

3. The affixing apparatus of an RFID label according to claim 1, wherein:

a tag pressing member is provided inside of said tag conveying drum, having an end portion thereof exposed in said tag sticking section so as to contact with said ID tag;

said tag pressing member is allowed to have two states, a protruding state having said end portion protruding from said drum surface and a non-protruding state having said end portion positioned approximately level with the drum surface; and said tag pressing member is in said protruding state at least when said ID tag and said display label are affixed.

4. The affixing apparatus of an RFID label according to claim 3, further comprising:

a rotation speed adjusting mechanism adjusting a rotation speed of said tag conveying drum, wherein:

in case that eliminating a defective ID tag by said defective elimination mechanism causes a tag absent area having no ID tag existing on said tag sticking section, in order to prevent contact between the tag absent area and said display label, by increasing the rotation speed of said tag conveying drum as well as turning said tag pressing member to said non-protruding state, said ID tag conveyed following said tag absent area is affixed to said display label.

5. The affixing apparatus of an RFID label according to claim 1, wherein:

said tag conveying drum rotates at a constant speed; and in case that said defective ID tag is eliminated on the first releasing member, by increasing a winding up speed of a winding-up device of the first releasing member, said non-defective ID tag is supplied to said tag conveying drum in a constant interval.

6. The affixing apparatus of an RFID label according to claim 1, wherein:

a winding up speed of the first releasing member is constant;

a rotating speed of said tag conveying drum is adjusted to one of the same as the winding up speed of the first releasing member, the same as a rotating speed of said label conveying drum or nil;

in case that said ID tag stuck on said tag sticking section is affixed to said display label, the rotating speed of said tag conveying drum is adjusted to the same speed as the rotating speed of said label conveying drum;

after said ID tag is affixed, the rotating speed of said tag conveying drum is changed to the same speed as the winding up speed of the first releasing member;

after said non-defective ID tag is supplied to said tag sticking section, the tag sticking section stops right before a contiguous area of said tag conveying drum and said label conveying drum, so as to synchronize with said display label to be affixed; and in case that said non-defective ID tag is not supplied to said tag sticking section since said defective elimination mechanism eliminates said defective ID tag, said non-defective ID tag is supplied to another tag sticking section subsequent to said tag sticking section, and then the tag sticking section stops right before a contiguous area of said tag conveying drum and said label conveying drum, so as to synchronize with said display label to be affixed.

7. The affixing apparatus of an RFID label according to claim 2, wherein:

a rotating speed of said tag selecting drum is constant;

a rotating speed of said tag conveying drum is adjusted to one of the same as the rotating speed of said tag selecting drum, the same as a rotating speed of said label conveying drum or nil;

in case that said ID tag stuck on said tag sticking section is affixed to said display label, the rotating speed of said tag conveying drum is adjusted to the same as the rotating speed of said label conveying speed;

after said ID tag is affixed, the rotating speed of said tag conveying drum is changed to the same as the rotating speed of the tag selecting drum;

after said non-defective ID tag is supplied to said tag sticking section, the tag sticking section stops right before a contiguous area of said tag conveying drum and said label conveying drum, so as to synchronize with said display label to be affixed; and in case that said non-defective ID tag is not supplied to said tag sticking section since said defective elimination mechanism eliminates said defective ID tag, said non-defective ID tag is supplied to another tag sticking section subsequent to said tag sticking section, and then the tag sticking section stops right before a contiguous area of said tag conveying drum and said label conveying drum, so as to synchronize with said display label to be affixed.

8. The affixing apparatus of an RFID label according to claim 1, further comprising:

(j) an object-to-affix eliminating mechanism eliminating the object-to-affix in case that said RFID label is not affixed to said object-to-affix; and (k) a control device controlling said object-to-affix eliminating mechanism and said display label supplying mechanism, wherein:

a winding up speed of said first releasing member, a rotating speed of said tag conveying drum and a conveying speed of said object-to-affix are constant;

in case that eliminating the defective ID tag by said defective elimination mechanism causes a tag absent area having no ID tag existing on said tag sticking section, in order to prevent contact between the tag absent area and said display label, the control device sends a supply stop signal to said label supplying mechanism so as not to supply said display label; and said object-to-affix having no RFID label affixed to is thereby formed, and said control device sends an eliminating signal to said object-to-affix eliminating mechanism so as to eliminate said object-to-affix.

9. The affixing apparatus of an RFID label according to claim 2, further comprising:

(k) an object-to-affix eliminating mechanism eliminating the object-to-affix in case that said RFID label is not affixed to said object-to-affix; and (l) a control device controlling said object-to-affix eliminating mechanism and said display label supplying mechanism, wherein:

a rotating speed of said tag selecting drum, a rotating speed of said tag conveying mechanism and a conveying speed of said object-to-affix are constant;

in case that eliminating said defective ID tag by said defective elimination mechanism causes a tag absent area having no ID tag existing on said tag sticking section, in order to prevent contact between the tag absent area and said display label, the control device sends a supply stop signal to said label supplying mechanism so as not to supply said display label; and said object-to-affix having no RFID label affixed to is thereby formed, and said control device sends an eliminating signal to said object-to-affix eliminating mechanism so as to eliminate said object-to-affix.

10. The affixing apparatus of an RFID label according to claim 1, wherein:

said non-defective ID tag released from said first releasing member is supplied to said tag conveying drum so as that said adhesive remained on the ID tag side contacts with a surface of the drum.

11. The affixing apparatus of an RFID label according to claim 2, wherein:

an incision or an index is formed on said ID tag in order to distinguish its back and front and also its direction.

12. The affixing apparatus of an RFID label according to claim 1, wherein:

said object-to-affix conveying mechanism, being a star wheel having a holder for said object-to-affix, conveys said object-to-affix according to rotation of said star wheel; and in a contiguous area of said label conveying drum and said star wheel, said RFID label is released from said label conveying drum, and then affixed to said object-to-affix.

13. The affixing apparatus of an RFID label according to claim 1, wherein:

said object-to-affix conveying mechanism is a conveyer having notches to hold said object-to-affix in a predetermined interval; and in a contiguous area of said label conveying drum and said conveyer, said RFID label is released from said label conveying drum, and then affixed to said object-to-affix.

14. An affixing method of an RFID label, comprising:

(a) preparing more than one display label having a display section on a front surface thereof and an adhesive surface on a back surface thereof and more than one ID tag including an antenna coil and an IC chip so as to transmit information to and from an external device through non-contact communication;

(b) writing predetermined information on said IC chips of said more than one ID tag prior to affixing to the display label, and then applying a reading test so as to separate non-defective ID tags having said information properly readable from defective ID tags having said information properly unreadable;

(c) printing additional display on a surface of said display label prior to affixing to the separated non-defected ID tag, and then affixing the separated non-defective ID tag on said adhesive surface thereof so as to form an RFID label having the non-defective ID tag and the printed display label united; and (d) affixing said RFID label to an object-to-affix, wherein an incision or an index is formed on said ID tag in order to distinguish back and front and also a direction thereof.

15. An affixing method of an RFID label, comprising:

(a) preparing more than one display label having a display section on a front surface thereof and an adhesive surface on a back surface thereof and more than one ID tag including an antenna coil and an IC chip so as to transmit information to and from an external device through non-contact communication;

(b) writing predetermined information on said IC chips of said more than one ID tag prior to affixing to the display label, and then applying a reading test so as to separate non-defective ID tags having said information properly readable from defective ID tags having said information properly unreadable;

(c) printing additional display on a surface of said display label prior to affixing to the separated non-defected ID tag, and then affixing the separated non-defective ID tag on said adhesive surface thereof so as to form an RFID label having the non-defective ID tag and the printed display label united; and (d) affixing said RFID label to an object-to-affix, wherein said ID tags are prepared in a state of being affixed to the tape-shaped releasing member in a predetermined interval.

16. The affixing apparatus of an RFID label according to claim 2, wherein:

a tag pressing member is provided inside of said tag conveying drum, having an end portion thereof exposed in said tag sticking section so as to contact with said ID tag;

said tag pressing member is allowed to have two states, a protruding state having said end portion protruding from said drum surface and a non-protruding state having said end portion positioned approximately level with the drum surface; and said tag pressing member is in said protruding state at least when said ID tag and said display label are affixed.

17. The affixing apparatus of an RFID label according to claim 4, wherein:

an incision or an index is formed on said ID tab in order to distinguish its back and front and also its direction.

18. The affixing apparatus of an RFID label according to claim 2, wherein:

said object-to-affix conveying mechanism, being a star wheel having a holder for said object-to-affix, conveys said object-to-affix according to rotation of said star wheel; and in a contiguous area of said label conveying drum and said star wheel, said RFID label is released from said label conveying drum, and then affixed to said object-to-affix.

19. The affixing apparatus of an RFID label according to claim 2, wherein:

said object-to-affix conveying mechanism is a conveyer having notches to hold said object-to-affix in a predetermined interval; and in a contiguous area of said label conveying drum and said conveyer, said RFID label is released from said label conveying drum, and then affixed to said object-to-affix.

* * * * *